US010689605B2

(12) United States Patent
Green et al.

(10) Patent No.: US 10,689,605 B2
(45) Date of Patent: Jun. 23, 2020

(54) LAUNDRY DETERGENT CAPSULE

(71) Applicant: Conopco, Inc., Englewood Cliffs, NJ (US)

(72) Inventors: Andrew David Green, Dobshill (GB); Matthew Charles Meyrick Pritchard, Reading (GB); Neil John Smith, Liverpool (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 16/300,699

(22) PCT Filed: May 12, 2017

(86) PCT No.: PCT/EP2017/061491
§ 371 (c)(1),
(2) Date: Nov. 12, 2018

(87) PCT Pub. No.: WO2017/198567
PCT Pub. Date: Nov. 23, 2017

(65) Prior Publication Data

US 2019/0153364 A1 May 23, 2019

(30) Foreign Application Priority Data

May 17, 2016 (EP) ..... 16169839

(51) Int. Cl.
*C11D 17/00* (2006.01)
*C11D 17/04* (2006.01)
(Continued)

(52) U.S. Cl.
CPC ..... *C11D 17/043* (2013.01); *B65D 1/42* (2013.01); *B65D 43/0202* (2013.01);
(Continued)

(58) Field of Classification Search
CPC ..... D06F 39/02; D06F 95/006; D06F 49/08; B65D 41/02; B65D 41/56; B65D 1/06; B65D 2543/00509; B65D 2553/425
See application file for complete search history.

(56) References Cited

U.S. PATENT DOCUMENTS 5,806,680 A 9/1998 Barthel et al.
7,703,631 B2 4/2010 Chafe et al.
(Continued)

FOREIGN PATENT DOCUMENTS

CN 1409682 4/2003
CN 1968829 5/2007
(Continued)

OTHER PUBLICATIONS

English translation of the Patent No. EP 2463 435 A2 (Jun. 13, 2012).*
(Continued)

*Primary Examiner* — Eisa B Elhilo
(74) *Attorney, Agent, or Firm* — Greenberg Traurig, LLP

(57) ABSTRACT

A laundry detergent capsule containing a laundry detergent composition, the capsule including a capsule base (33) with one or more side walls (35) extending from the base to form a detergent composition cavity accommodating the laundry detergent composition (39), wherein the capsule includes a capsule lid (41) for sealing the detergent composition cavity and the capsule lid includes a flange (43) extending from a lid portion and abutting the side wall or side walls, The flange having 2, 3, 4, 5 or 6 breaks or gaps arranged symmetrically around the circumference of the upper rim of the side wall or walls. a container containing a plurality of such capsules and use of such capsules to launder textiles.

8 Claims, 8 Drawing Sheets

(51) Int. Cl.

| | |
|---|---|
| ***B65D 65/46*** | (2006.01) |
| ***B65D 1/42*** | (2006.01) |
| ***B65D 43/02*** | (2006.01) |
| ***C11D 11/00*** | (2006.01) |

(52) U.S. Cl.

CPC ..... *B65D 65/46* (2013.01); *C11D 11/0017* (2013.01); *C11D 17/042* (2013.01); *C11D 17/045* (2013.01); *B65D 2543/00083* (2013.01); *B65D 2543/00092* (2013.01); *B65D 2543/00101* (2013.01); *B65D 2543/00111* (2013.01); *B65D 2543/00185* (2013.01); *B65D 2543/00296* (2013.01); *B65D 2543/00425* (2013.01); *B65D 2543/00509* (2013.01); *B65D 2543/00537* (2013.01)

(56) References Cited

U.S. PATENT DOCUMENTS

| | | | | |
|---|---|---|---|---|
| 2003/0234252 | A1 | 12/2003 | Howard | |
| 2006/0124646 | A1* | 6/2006 | Guglielmini ..... | B65D 65/46 220/500 |
| 2009/0110723 | A1 | 4/2009 | McAllister | |

FOREIGN PATENT DOCUMENTS

| | | | | |
|---|---|---|---|---|
| CN | 101827571 | | 9/2010 | |
| DE | 19537671 | | 4/1997 | |
| DE | 102014206095 | | 10/2015 | |
| EP | 0947443 | | 10/1999 | |
| EP | 2463 435 | A2 * | 6/2012 | ..... D06F 39/02 |
| GB | 539891 | | 9/1941 | |
| GB | 2013235 | | 8/1979 | |
| GB | 2375517 | | 11/2002 | |
| GB | 2375542 | | 11/2002 | |
| GB | 2401848 | | 11/2004 | |
| JP | 8119370 | | 5/1996 | |
| WO | WO0136290 | | 5/2001 | |
| WO | WO2004005156 | | 1/2004 | |

OTHER PUBLICATIONS

Search Report and Written Opinion in PCTEP2017061491; dated Jun. 23, 2017.

Search Report and Written Opinion in EP16169839; dated Nov. 8, 2016.

Search Report and Written Opinion in PCTEP2017061477; dated Jul. 13, 2017.

Search Report and Written Opinion in EP16169837; dated Jan. 12, 2017.

Co-pending application; filed Nov. 12, 2018

* cited by examiner

LAUNDRY DETERGENT CAPSULE

FIELD OF INVENTION

The present invention relates to a laundry detergent capsule with one or more internal reinforcing structures, such as a reinforced lid.

BACKGROUND

Laundry detergent capsules come in a variety of shapes and sizes, but are usually in the form of a cylinder or a cuboid made up of a capsule base, a capsule lid and one or more side wall extending from the capsule base to the capsule lid to encase a laundry detergent composition. WO2004/005156 A1 describes a water-soluble container with one or more discrete chambers for containing product, such as a detergent composition. The capsule may be made by thermoforming the base and side walls to form a laundry detergent capsule enclosure, filling the enclosure with a laundry detergent composition and sealing the capsule with a flat laundry detergent capsule lid.

SUMMARY OF THE INVENTION

The joint between the lid and the sidewall may be weak, potentially resulting in premature breakage of the capsule and leakage of the laundry detergent composition. The present inventors have investigated methods of improving the structural integrity of laundry detergent capsules. At its most general, the present invention provides a laundry detergent capsule containing a laundry detergent composition, wherein the capsule includes a capsule base, one or more capsule side walls and a capsule lid to form a capsule cavity containing the laundry detergent composition, and the capsule further includes one or more reinforcing structures within the cavity for reinforcing the capsule. In particular, the present invention provides a laundry detergent capsule containing a laundry detergent composition, the capsule including a capsule lid with a flange adapted to engage with a capsule side wall or side walls encasing the laundry detergent composition.

In a first aspect, the present invention provides a laundry detergent capsule containing a laundry detergent composition, the capsule including a capsule base with one or more side walls extending from the base to form a detergent composition cavity accommodating the laundry detergent composition, wherein the capsule includes a capsule lid for sealing the detergent composition cavity and the capsule lid includes a flange extending from a lid portion and the flange being configured to abut the side wall or side walls. In this way, the joint between the capsule lid and the capsule side wall or side walls is reinforced.

In a second aspect, the present invention provides a laundry detergent capsule lid includes a flange extending from a lid portion and the flange being configured to abut the side wall or side walls of a laundry detergent capsule enclosure.

In a third aspect, the present invention provides a container including a plurality of laundry detergent capsules according to the first aspect.

In a fourth aspect, the present invention provides the use of a laundry detergent capsule according to the first aspect to launder textiles.

In a fifth aspect, the present invention provides a method of producing a laundry detergent capsule containing a laundry detergent composition, the method include the step of sealing a laundry detergent capsule lid as described herein onto a laundry detergent capsule enclosure as described herein containing the laundry detergent composition, optionally sealing with sonic welding.

In a sixth aspect, the present invention provides a method of producing a laundry detergent capsule lid of the second aspect, the method including the step of injection-moulding the laundry detergent capsule lid with a mould adapted to form the laundry detergent capsule lid of the second aspect.

DETAILED DESCRIPTION

Figure 17A:
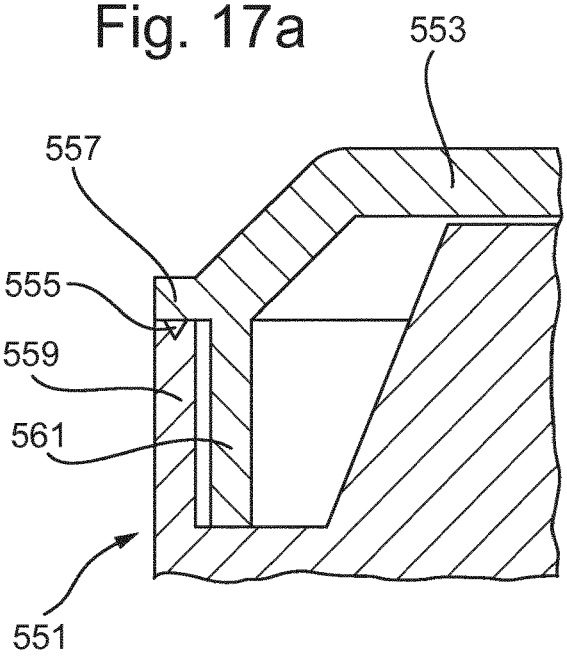
Figure 17B:
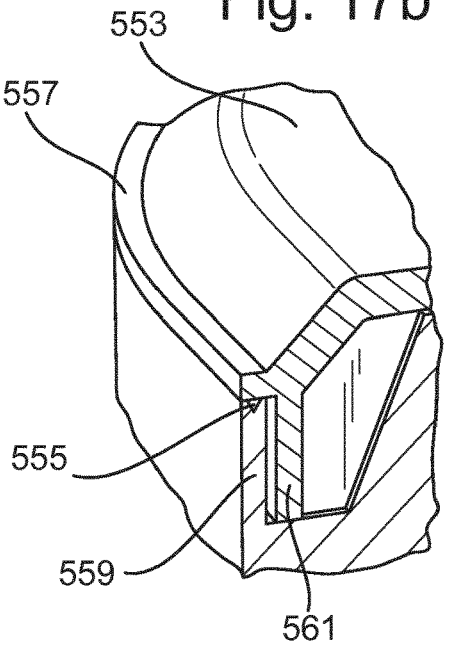

FIGS. 17*a* and 17*b* show cross-sectional views of the upper rim of the capsule side wall and the capsule lid including a sonic welding wedge.

GENERAL CAPSULE STRUCTURE

The laundry detergent capsule of the present invention includes a capsule base, one or more side walls extending from the base and sealed with a capsule lid. The capsule lid is typically connected to an upper end of capsule side wall or side walls and the base is typically connected to a lower end of the capsule side wall or side walls. In this way, the internal surfaces of the capsule base, capsule lid and side wall or side walls can form a capsule cavity accommodating the laundry detergent composition.

The laundry detergent capsule may be any three-dimensional shape that forms a satisfactory capsule for holding a laundry detergent composition. Examples of shapes of capsules include, but are not limited to, truncated spherical, cylindrical (circular or elliptical), truncated conical (circular or elliptical), cube, cuboid, triangular prism, pentagonal prism, hexagonal prism or derivatives thereof. Certain shapes typically have a single side wall (such as truncated spherical, cylindrical and truncated conical), while others typically have more than one side wall (such as cube, cuboid, triangular prism, pentagonal prism, hexagonal prism).

The capsule of the present invention may be formed of two parts, a laundry detergent enclosure and the capsule lid, where the laundry detergent enclosure includes the capsule base and the capsule side walls extending generally upwardly from the base to form a cavity in which the laundry detergent composition can be housed. The laundry detergent enclosure typically has an enclosure aperture created by the upper rim of the capsule side wall or side walls. The laundry detergent composition may be added to the laundry detergent enclosure through the enclosure aperture.

The thickness of the walls of the capsule (e.g. the thickness of the capsule base, capsule lid and the side wall or side walls) is not particularly limited. Generally, the walls of the capsules described herein will include a water-soluble material. The thickness of such walls may be of a thickness to provide a structurally integral capsule and to allow an appropriate dissolution profile in use. The thickness of the capsule wall or walls may be 200 μm or more. In some embodiments, the thickness of the capsule wall or walls is 300 μm or more, 400 μm or more, 500 μm or more, or 600 μm or more. In some embodiments, the thickness of the capsule wall or walls is in the range of 0.2 to 5 mm. In some embodiments, the thickness of the capsule walls is in the range of 0.3 to 4 mm, 0.4 to 3.5 mm, 0.5 to 3 mm or 0.6 to 2.5 mm.

Capsule Lid

The capsule lid is generally adapted to seal the enclosure aperture when forming the laundry detergent capsule (housing the laundry detergent composition). The capsule lid of the present invention includes a lid portion and a flange extending from the lid portion to abut the side wall or side walls of the capsule. In this way, the upper portion of the side wall or side walls may be reinforced so that the capsule may be resilient to external forces, for example, during transport and/or the flange may reinforce the joint between the capsule lid and the side wall or side walls. In some embodiments, the flange is a ridge or rim extending downwardly from the lid portion.

The lid portion is generally adapted to form a seal at the upper rim of the capsule side wall or side walls. In this way, the lid portion (and more generally the capsule lid) may cover the enclosure aperture and seal the laundry detergent capsule. The shape of the lid portion may be selected depending on the shape of the enclosure aperture formed by the upper rim of side wall or side walls. For example, the shape of the lid portion may be circular, elliptical, triangular, square, rectangular, pentagonal or hexagonal. The lid portion may be substantially planar. In some embodiments, the lid portion is substantially flat.

The flange of the capsule lid is configured to abut the side wall or side walls. In some embodiments, a lower surface of the flange abuts a complementary upwardly facing surface (such as a side wall shelf or ledge) of the side wall or side walls. In this way, the flange may rest on the upwardly facing surface of the side wall or side walls to provide support. Additionally or alternatively, an outer surface of the flange abuts an inner surface of the side wall or side walls, or an inner surface of the flange abuts an outer surface of the side wall or side walls.

In some embodiments, the capsule includes a gap of 5 mm or less, 4 mm or less, 3 mm or less, 2 mm or less, or 1 mm or less between an outer surface of the flange and an inner surface of the side wall or side walls, or between an inner surface of the flange and an outer surface of the side wall or side walls. In some embodiments, the gap between the surface of the flange and the surface of the side wall or side walls is in the range of 0.01 to 5 mm, 0.05 to 4 mm, 0.1 to 3 mm, 0.2 to 2 mm, or 0.3 to 1 mm. Such a gap may help to weaken or break the joint or seal between the side wall or side walls and the capsule lid assisting release of the laundry detergent composition.

The flange may extend downwardly from the lid portion any distance up to the height of the capsule side wall or side walls. In some embodiments, the flange extends downwardly from the lid portion up to 60% of the height of the capsule side wall or side walls. In some embodiments, the flange extends downwardly from the lid portion in the range of 30 to 60% of the height of the capsule side wall or side walls. In this way, the flange may abut a significant portion of the side wall or side walls to reinforce capsule. In alternative embodiments, the flange extends downwardly from the lid portion in the range of 5 to 25% of the height of the capsule side wall or side walls. In this way, the reinforcing effect of the flange may be present with minimal use of flange material.

In some embodiments, the flange forms a flange rim or ridge, the peak of the flange rim or ridge extends concentrically with the upper rim of side wall or side walls and the flange rim or ridge extends for 80% or more of the circumference or perimeter of the upper rim of the side wall or side walls. In other words, the flange forms a flange rim or ridge configured to extend around 80% or more of the circumference or perimeter of the upper rim of the side wall or side walls abutting or in close proximity to the inner or outer surface of the side wall or side walls.

The flange rim or ridge may be a single continuous rim or ridge or may be a rim or ridge interrupted by one or more by one or more breaks (or gaps). When the flange rim or ridge is a single continuous rim or ridge, the rim or ridge may extend around the entire circumference or perimeter of the upper rim of the side wall or side walls. Alternatively, when the flange rim or ridge is a single continuous rim or ridge, the rim or ridge may extend around 80% or more of the circumference or perimeter of the upper rim of the side wall or falls and further include a single gap or break in the ridge. The gap or break in the flange rim or ridge will extend no more than 20% of the circumference or perimeter of the upper rim of the side wall or side walls.

When the flange rim or ridge is interrupted by one or more breaks (or gaps), the flange rim or ridge may effectively split into two or more rims or ridges separated by the gap or break. In this case, there will be two or more gaps in the ridge over the entire circumference or perimeter of the upper rim of the side wall or side walls. Thus, the flange may be a flange rim or ridge including two or more gaps or breaks wherein the flange rim or ridge extends in total along 80% or more of the perimeter or circumference of the upper rim of the side wall or side walls and the gaps or breaks extend in total along 20% or less of the perimeter or circumference of the upper rim of the side wall or side walls.

The areas of the capsule where the flange rim or ridge includes a break (or gap) may form a thinner area of the capsule material when compared where the flange rim or ridge abuts the side wall. The dissolution of the capsule material may occur at a faster rate where there is a break in the flange rim or ridge compared to areas where the flange rim or ridge abuts the side wall when in use (i.e. during a laundry wash). As a result, water may initially enter the capsule at the areas where the breaks or gaps in the flange rim or ridge exist and create pressure from within the capsule to weaken the joint or seal between the lid and the laundry detergent enclosure, in use.

The number of gaps or breaks is not particularly limited so long as the reinforcing nature of the flange rim or ridge is not adversely affected. For example, the flange rim or ridge may have a number of breaks in the range selected from 1 to 12, or 1 to 6. When the flange rim or ridge contains 2 or more breaks or gaps, the breaks may be arranged symmetrically around the circumference or perimeter of the upper rim of the side wall or side walls. In some embodiments, the flange rim or ridge has 2, 3, 4, 5 or 6 breaks or gaps arranged symmetrically around the circumference or perimeter of the upper rim of the side wall or side walls.

The shape of the gap or break is not particularly limited. For example, the gap or break may be circular, triangular, square or rectangular. In some embodiments, the gap may be triangular (or truncated triangular) with the thin portion of the gap at the lid portion. Such an arrangement may improve the escape of air from the cavity when the capsule lid is placed on the capsule enclosure and/or may help flexing of the lid to fit the flange rim or ridge into the interior or exterior of the upper rim of the side wall or side walls.

The flange may abut or be in close proximity to an inner surface of the side wall or side walls or an outer surface of the side wall or side walls. In particular embodiments, the flange abuts or is in close proximity to an inner surface of the side wall or side walls. In this way, the flange can provide an internal reinforcing wall within the side wall or side walls.

In some embodiments, the capsule lid may include a flange abutting or in close proximity to an inner surface and a flange abutting or in close proximity to an outer surface. The flange abutting or in close proximity to the inner surface may abut or be in close proximity to a portion of the side wall abutted by or in close proximity to the outer flange, either partially or completely. In alternative embodiments, the inner flange and the outer flange abut or are in close proximity to different portions of the side wall (i.e. there is no overlap).

Where the flange abuts or is in close proximity to the inner surface of the side wall or side walls, the lid portion typically includes a lip portion abutting the upper rim of the side wall or side walls. The lip portion may extend beyond the flange to providing a sealing surface on the lid portion for sealing with the upper rim of the side wall or side walls. In some embodiments, the outer circumference or perimeter of the lid portion is arranged to be flush with the outer surface of the side wall or side walls.

In some embodiments, the lid includes a sonic energy-directing portion protruding from a lower surface of the lid configured to abut a sealing portion of the capsule side wall. The sonic energy-directing portion is adapted to funnel sonic waves from the lid to a point where the lid is in contact with the capsule base when using sonic welding to seal the lid to the capsule base and side walls (i.e. the capsule enclosure). In some embodiments, the sonic energy-directing portion is positioned on the same side of the lid as the flange and closer to the edge of the lid than the flange. In this way, the lid can be sealed with the flange on the inside of the capsule cavity and the joint have a simple appearance on the outside for the user.

Typically, the sonic energy-directing portion is a tapered piece of the lid such that thickness of the portion is larger at the attachment point to the lid than the thickness of the portion where the portion abuts the capsule side wall. In this way, the energy from the sonic welding may be concentrated at the sealing point between the lid and the capsule wall. The sonic energy-directing portion may be triangular in shape.

In some embodiments, the sonic energy-directing portion extends around the entire circumference of the lid portion. In these embodiments, breaks or gaps may exist in the sonic energy-directing portion provided that the sonic energy-directing portion exists around at least 80% or at least 90% of the circumference of the lid portion. Alternatively, one or more individual sonic energy-directing portions may be positioned around the circumference of the lid portion. For example, two, three, four, five, six, seven, or eight individual sonic energy-directing portions may be spaced on the circumference of the lid portion. Each individual sonic energy-directing portion may be positioned evenly around the circumference of the lid portion.

Capsule Base

The capsule base may be substantially planar. In this way, the base may rest on a surface while the capsule is not in use (e.g. during transport or storage). In some embodiments, the base is substantially flat.

The shape of the lid and base are not particularly limited. For example, the lid and/or base independently may be circular, elliptical, triangular, square, rectangular, pentagonal or hexagonal in shape. In some embodiments, the shape of the capsule lid is the same as the shape of the capsule base.

Capsule Side Wall or Side Walls

The capsule side wall or side walls extend from the base. Typically, the side wall or side walls extend in a generally upwardly direction from the base. In this way, the capsule base and the capsule side wall or side walls may form a capsule enclosure with a capsule cavity for housing the laundry detergent composition and a cavity aperture defined by the upper rim of the side wall or side walls. The capsule side wall or side walls may thus form a barrier to prevent loss of laundry detergent composition from the enclosure and the capsule (when sealed with the capsule lid).

The side wall or side walls may extend from the base in a straight line, curved line or in an irregular direction in any way as to form a cavity for holding the laundry detergent composition.

The side wall or side walls may be adapted to engage with the flange of the capsule lid. In some embodiments, the side wall includes or side walls include a supporting portion for engaging with the flange of the capsule lid. The supporting portion may include a shelf protruding from at least part of the side wall or side walls on which the flange rests such that the flange is supported. The shelf may protrude substantially horizontally from the at least part of the side wall or side walls.

In some embodiments, the upper rim of the side wall or side walls has an indentation to accommodate and engage at least part of the flange of the capsule lid. In some embodiments, the thickness of the upper rim of the side wall or side walls is less than another portion of the side wall or side walls. In this way, an indentation in the side wall may be created.

In some embodiments, the thickness of the capsule wall where the flange of the capsule lid abuts or is in close proximity to the side wall is the same thickness up to and including twice as thick as the thickness of another portion of the capsule wall (e.g. a lower portion of the side wall or side walls. In some embodiments, the thickness of the capsule wall where the flange of the capsule lid abuts or is in close proximity to the side wall is in the range of 1.05 to 1.95 times, 1.10 to 1.90, 1.25 to 1.75 times, or 1.40 to 1.60 times as thick as the thickness of another portion of the capsule wall (e.g. a lower portion of the side wall or side walls).

In particular embodiments, the upper rim of the side wall or side walls includes an L-shaped groove or indentation to engage and support the flange of the capsule lid. As described herein, an L-shaped groove as described herein is an indentation in the side wall with a generally L-shaped cross-section. In this way, the upper rim has an indentation to accommodate at least part of the flange of the capsule lid and a shelf protruding from at least part of the side wall or side walls.

The shape of the sidewalls may be adapted to fit the shape of the capsule lid and capsule base such that the side walls connect the capsule lid with the capsule base to enclose a laundry detergent composition. The shape of the capsule may be cubic, cuboid, cylindrical or truncated conical.

Capsule Cavity

The capsule cavity is defined by the inner surfaces of the capsule base, capsule lid and the side wall or side walls. The laundry detergent composition is housed in the cavity of the laundry detergent capsule. The laundry detergent composition may occupy 70% or more, 75% or more, 80% or more, 85% or more, 90% or more, 95% or more or substantially all of the total volume of the internal cavity of the capsule.

In some embodiments, the internal cavity includes air. In other words, a portion of the volume of the internal cavity is occupied by the air. Namely, the capsule may contain some headspace. Such headspace (e.g. air in internal cavity of the capsule) may allow easier filling of the laundry detergent composition into the laundry detergent enclosure and easier sealing of the capsule lid onto the filled laundry detergent capsule. For example, including air as part of the volume of the cavity may avoid overfilling or spilling of laundry detergent composition when filling the laundry detergent enclosure, or before or during sealing the capsule. In some embodiments, air occupies 5% or less, 10% or less, 15% or less, 20% or less, 25% or less, or 30% or less of the total volume of the internal cavity of the capsule In some embodiments, the capsule has an internal volume of in the range of 10 to 75 ml, 15 to 50 ml, or 15 to 25 ml. Such an internal volume can house a single dose of laundry detergent composition.

Internal Reinforcement Structures

The walls of a laundry detergent capsule may be relatively thin in order to provide sufficient access to the laundry detergent composition in use, either by dissolution of some or all of the walls by water or breaking of the capsule during use. However, it is undesirable for the capsule to break before use, potentially resulting in premature leakage of the laundry detergent composition.

To address this problem, the laundry detergent capsule may include an internal capsule cavity holding the laundry detergent composition, wherein the capsule includes one or more reinforcing structures within the internal capsule cavity. The reinforcing structure may be a reinforcing rib attached to an interior surface of the laundry detergent cavity and adapted to abut against another interior surface of the laundry detergent cavity when a force is exerted on the laundry detergent capsule.

When the capsule includes one or more reinforcing ribs, each rib may be attached to the interior surface of the capsule lid, the capsule base and/or one or more of the capsule side walls. In particular embodiments, a reinforcing rib is either attached to the capsule lid or is attached to the capsule base and at least one capsule side wall. In this way, the reinforcing rib either forms part of the lid or part of the capsule enclosure.

Capsule Enclosure Reinforcing Rib

In some embodiments, the laundry detergent capsule enclosure for receiving a laundry detergent composition includes a capsule base attached to one or more capsule side walls extending from the base to form a detergent composition cavity for accommodating the laundry detergent composition, wherein the capsule further includes one or more reinforcing ribs within the detergent composition cavity and attached to the interior surface of the capsule base and the capsule side wall or at least one capsule side wall.

The laundry detergent capsule enclosure may additionally or alternatively include a capsule base with one or more side walls extending from the base to form a detergent composition cavity for accommodating a flowable (e.g. liquid or gel) laundry detergent composition, and the capsule further includes enclosure further includes a flow control portion within the detergent composition cavity for controlling the flow of the liquid or gel laundry detergent composition when initially added to the capsule enclosure.

The laundry detergent capsule described herein may include a capsule base attached to one or more capsule side walls extending from the base to form a detergent composition cavity accommodating the laundry detergent composition. The detergent composition cavity may include one or more reinforcing structures within the cavity. Typically, the reinforcing structure is a reinforcing rib attached to the capsule base and the side wall or at least one side wall.

In some embodiments, the reinforcing rib extends upwardly from the base and at least partially along the interior surface of the side wall. The reinforcing rib may be a substantially planar and extending out of the plane of (in particular embodiments, substantially perpendicular to) a substantially planar capsule base.

The height of the reinforcing rib with respect to the capsule base may vary along its length or may be substantial constant. When the height of the reinforcing rib is substantially constant along its length with respect to the capsule base, the height of the reinforcing rib may be 20% or more, 30% or more, 40% or more, or 50% or more of the height of the side wall or side walls. When the height of the reinforcing rib is substantially constant along its length with respect to the capsule base, the height of the reinforcing rib may be 80% or less, 70% or less, 60% or more, or 50% or more of the height of the side wall or side walls. When the height of the reinforcing rib is substantially constant along its length with respect to the capsule base, the height of the reinforcing rib may be in the range of 20 to 80%, 30 to 70%, or 40 to 60% of the height of the side wall or side walls. Where the side wall does not extend substantially vertically from the base, the reinforcing rib or ribs may match the contour of the side wall until the reinforcing rib attaches to the side wall.

The reinforcing rib or ribs of the capsule may extend radially along the capsule base. The rib may extend radially to the centre of the capsule base or may extend partially along a line from the side wall to the centre of the capsule base.

In some embodiments, the capsule includes a plurality of reinforcing ribs. In some embodiments, the capsule includes in the ranges of 2 to 10 reinforcing ribs, 3 to 8 reinforcing ribs, or 4 to 8 reinforcing ribs. The plurality of reinforcing ribs may be arranged symmetrically around the perimeter or circumference of the side wall or side walls.

In particular embodiments, the capsule includes 4 to 8 reinforcing ribs arranged symmetrically around the perimeter or circumference of the side wall or side walls wherein each reinforcing rib extends radially to the centre of the capsule base or extends partially along a line from the side wall to the centre of the capsule base.

In some embodiments, the reinforcing rib extends across the entire diameter or width of the capsule base and is attached at two points to the side wall or side walls. In this way, the reinforcing rib may divide the capsule cavity into two or more compartments. In particular embodiments, the capsule includes one, two, three or four reinforcing rib(s) extending across the entire diameter or width of the capsule base. Where the capsule includes a plurality of the reinforcing ribs extending across the entire diameter or width of the capsule base, two or more of the reinforcing ribs may intersect. In particular embodiments, all of the plurality of the reinforcing ribs extending across the entire diameter or width of the capsule base intersect at a single point, optionally substantially centrally on the capsule base.

In some embodiments, the capsule includes a flowable (e.g. liquid or gel) laundry detergent composition, a flow control portion within the laundry detergent cavity and the reinforcing rib extends from the side wall to the flow control portion.

Lid Reinforcing Ribs

In particular embodiments, the capsule lid includes one or more lid reinforcing ribs extending from a lower surface of the capsule lid portion. Typically, the lid reinforcing rib or ribs are rigid sheet-like structures with two major axes and a minor axis. The major axes may be the rib height and the rib length and the minor axis may be the rib thickness. As described herein, the rib height is the distance that the rib extends from the lid towards the capsule base; the rib length and the rib thickness are the distances the rib extends from one capsule side wall to another capsule side wall, with the length being the large dimension and the thickness being the smaller dimension.

Typically, the lid reinforcing ribs are attached to the lid portion closer to the centre of the lid portion than the attachment of the lid flange to the lid portion. The lid reinforcing rib or ribs may extend from a central point of lid portion to an interior surface lid flange.

The lid reinforcing ribs extend at least 80%, at least 90% or at least 95% of the height of the cavity towards the base of the capsule enclosure. In this way, there is a small gap or no gap between the lid reinforcing rib and the capsule base. As a result, the lid reinforcing ribs may provide structural support to the capsule when a force is applied to the capsule.

The laundry detergent capsule may include a plurality of lid reinforcing ribs. For example, the laundry detergent capsule may include two, three, four, five, six, seven or eight lid reinforcing ribs. The plurality of lid reinforcing ribs may be arranged symmetrically and/or evenly spaced on the lid. In this way, the reinforcing ribs can spread any force exerted on the capsule over a number of the ribs.

Two or more of the lid reinforcing ribs may meet at a single point. The lid reinforcing ribs may meet at a central point of the lid portion. As a result, a strong reinforcement point can be created at the centre of the capsule. Where two or more lid reinforcing ribs meet at a single point and extend beyond that point, the lid reinforcing ribs intersect at the meeting point.

One or more of lid reinforcing ribs may include one or more ancillary lid reinforcing ribs attached to the lid reinforcing rib and projecting at an angle to the main plane of the lid reinforcing rib. In particular embodiments, the ancillary lid reinforcing rib or ribs projects orthogonally to the major plane of lid reinforcing rib. The ancillary lid reinforcing rib or ribs may independently be positioned in the range of 40 to 60%, 45 to 55% or about half way along a length of the lid reinforcing rib. The ancillary lid reinforcing rib or ribs may be smaller than lid reinforcing ribs, may be 20 to 80% of the length, may be 30 to 70%, may be 40 to 60% of the length. In some embodiments, the ancillary lid reinforcing ribs are the same height as the lid reinforcing ribs.

Typically, the lid reinforcing ribs are formed as a single piece with the lid portion. In some embodiments, the laundry detergent capsule includes either the lid reinforcing ribs or the capsule enclosure reinforcing ribs. In other words, the laundry detergent capsule does not include both the lid reinforcing ribs and the capsule enclosure reinforcing ribs in some embodiments.

Reinforcing Rib Engagement Portion

When the capsule includes one or more capsule enclosure reinforcing ribs, the capsule lid may include a lid portion and a lid reinforcing rib engagement portion. The lid reinforcing rib engagement portion may extend downwardly from a lower surface of the lid portion into the cavity to engage with one or more reinforcing ribs in the capsule cavity. The lid reinforcing rib engagement portion may be a tubular (e.g. cylindrical, square, rectangular, pentagonal, or hexagonal) portion extending downwardly and include one or more slots or indentations to receive and engage with the reinforcement rib or ribs.

The tubular lid reinforcing rib engagement portion may be hollow. In these embodiments, the lid reinforcing rib engagement portion may include reinforcing struts attached to an interior surface of the hollow tubular lid reinforcing rib engagement portion for reinforcing the lid reinforcing rib engagement portion. For example, the lid reinforcing rib engagement portion may include a reinforcing strut attached to the capsule lid portion and at least one interior surface of the hollow tubular lid reinforcing rib engagement portion. For example, the lid reinforcing rib engagement portion may include a cross-shaped strut attached to the lower surface of the capsule lid portion and the interior surfaces of the hollow tubular lid reinforcing rib engagement portion. The reinforcing strut may abut or rest upon at least part of a reinforcing rib of the capsule.

The lid reinforcing rib engagement portion may downwardly extend from the capsule lid portion substantially the whole height of the capsule cavity to the capsule base. In this way, the lid reinforcing rib engagement portion may provide additionally capsule reinforcement. Alternatively, the lid reinforcing rib engagement portion may downwardly extend from the capsule lid portion up to 40%, up to 50%, up to 60% up to 70%, up to 80% or up to 90% of the height of the capsule cavity.

When the capsule includes one lid reinforcing ribs, the capsule enclosure may include one or more capsule enclosure reinforcing rib engagement portions. A capsule enclosure reinforcing rib engagement portion or portions may be attached to the base of the capsule enclosure, a side wall of the capsule enclosure, or both the base and a side wall of the enclosure.

A capsule enclosure reinforcing rib engagement portion may be formed by two opposed guiding portions with a gap between the guiding portions to guide and receive a lid reinforcing rib. The gap between the guiding portions may be tapered such that the gap is wider at the mouth of the gap than at the base of the gap. In this way, the lid reinforcing rib may be guided into the gap from the mouth to the base of the guiding portions.

In some embodiments, the number of capsule enclosure reinforcing rib engagement portions in the capsules is the same as the number of lid reinforcing ribs in the laundry detergent capsule. The laundry detergent capsule enclosure may include two, three, four, five, six, seven or eight capsule enclosure reinforcing rib engagement portions.

Flow Control Portion

In some embodiments, the capsule includes a flow control portion within the cavity. Typically, the flow control portion is a hollow tubular (e.g. cylindrical, square or rectangular tube) portion extending upwardly from the capsule base. Typically, the height of the hollow tubular portion is lower than the height of the capsule side wall or side walls. In this way, the flowable laundry detergent composition can be added to the interior of the tubular flow portion and splash from the flowable laundry detergent composition may be contained within the hollow flow portion.

In some embodiments, the flow control portion is positioned in a central portion of the cavity. The tubular control flow portion may extend upwardly from a central portion of the capsule base.

The hollow tubular flow control portion may include one or more flow outlets for allowing flowable laundry detergent composition to flow from within the tubular flow control portion to other parts of the capsule cavity. The size, shape and position of each flow outlet is not particularly limited. For example, a flow outlet may be an aperture in a flow control portion wall. The flow outlet aperture may be circular, elliptical, square, rectangular, pentagonal, hexagonal or irregular in shape. The flow outlet aperture may be positioned in any position in the flow control portion wall. For example, the centre of the flow outlet aperture may be positioned The flow outlet may be an indentation in a flow control portion wall. In other words, the flow outlet may be a cut or notch in the flow control portion wall extending downwardly from an upper rim of the flow control portion wall. In these embodiments, the indentation may be a square or tongue-shaped indentation extending from the upper rim of the flow control portion. The indentation may extend downwardly from the upper rim of the flow control portion up to 50%, up to 60%, up to 70%, up to 80% or up to 90% of the height of the flow control portion wall. Alternatively, the indentation may extend downwardly for substantially the whole height of the flow control portion wall.

The flow control portion may include a single flow outlet or a plurality of flow outlets. In some embodiments, the flow control portion includes a number of flow outlets in the range of 2 to 12, 3 to 10, or 4 to 8. In some embodiments, the flow control portion has 2, 4, 6, 8 or 10 flow outlets. In some embodiments, the flow outlets may be arranged symmetrically around the circumference or perimeter of the flow control portion.

In some embodiments, the flow control portion includes at least two flow outlets arranged either side of a reinforcing rib within the cavity.

When the flow control portion does not include one or more flow outlets, the flowable laundry detergent composition may flow to other parts of the capsule cavity by flowing over an upper rim of the hollow flow control portion.

The flow control portion may be made of the same material as the capsule base. In some embodiments, the control portion is formed as a single piece with the capsule base, for example, by injection-moulding the capsule base and flow control portion.

The internal reinforcing structures and flow control portion independently form an aspect of the present invention. The present invention may provide a laundry detergent capsule containing a laundry detergent composition, the capsule including a capsule base attached to one or more capsule side walls extending from the base to form a detergent composition cavity accommodating the laundry detergent composition and a capsule lid for sealing the detergent composition cavity, wherein the capsule further includes one or more reinforcing ribs within the detergent composition cavity and attached to the interior surface of the capsule base and the capsule side wall, at least one capsule side wall, or the capsule lid. In this way, the capsule enclosure is reinforced internally from, for example, external forces.

The present invention may provide a laundry detergent capsule containing a flowable (e.g. liquid or gel) laundry detergent composition, the capsule including a capsule base with one or more side walls extending from the base to form a detergent composition cavity accommodating the laundry detergent composition and a capsule lid for sealing the detergent composition cavity, and the capsule further includes enclosure further includes a flow control portion within the detergent composition cavity for controlling the flow of the liquid or gel laundry detergent composition when initially added to the capsule.

The present invention may provide a laundry detergent capsule enclosure for receiving a laundry detergent composition, the capsule enclosure including a capsule base attached to one or more capsule side walls extending from the base to form a detergent composition cavity for accommodating the laundry detergent composition, wherein the capsule further includes one or more reinforcing ribs within the detergent composition cavity and attached to the interior surface of the capsule base and the capsule side wall or at least one capsule side wall.

The present invention may provide a laundry detergent capsule enclosure for receiving a flowable (e.g. liquid or gel) laundry detergent composition, the capsule enclosure including a capsule base with one or more side walls extending from the base to form a detergent composition cavity for accommodating the laundry detergent composition, and the capsule further includes enclosure further includes a flow control portion within the detergent composition cavity for controlling the flow of the liquid or gel laundry detergent composition when initially added to the capsule enclosure.

Capsule Dimensions

The dimensions of the capsule are not particularly limited. In some embodiments, the capsule has a dimension in the range of 1.5 to 5.0 cm. In some embodiments, the capsule has height, diameter, width and depth in the range of 1.5 to 5.0 cm.

In some embodiments, the capsule has a height of between 1.5 and 2.5 cm. The height allows the capsules to be packaged in a two-dimensional array of capsules with a height of less than 3.8 cm. In some embodiments, the height of the capsule is in the range of 1.7 to 2.3 cm.

The capsule lid or capsule base may have a lateral dimension of between 3.0 and 5.0 cm. In some embodiments, the lateral dimension is in the range of 4.0 to 4.8 cm.

Where the capsule lid or capsule base is a circle, the lateral dimension is the diameter of the circle. With other shapes, the shape typically has a width and a depth, and the lateral dimension is the longer of the width and depth. For example, the lateral dimension may be the length along the major axis of an ellipse. In particular embodiments, the capsule lid has a width and a depth and the width and depth are independently in the range of 3.0 and 5.0 cm, in the range 3.1 to 4.9 cm, or in the range of 4.0 to 4.8 cm. Additionally or alternatively, the capsule base has a width and a depth, and the width and depth are independently in the range of 3.0 and 5.0 cm, in the range 3.1 to 4.9 cm, or in the range of 4.0 to 4.8 cm.

Capsule Surface Area

In some embodiments, the total surface area of the exterior surfaces of the capsule is in the range of 60 to 90 $cm^2$. In some embodiments, the total surface area of the interior surfaces of the capsule is in the range of 55 to 85 $cm^2$, 60 to 80 $cm^2$ or 70 to 80 $cm^2$. The mass of capsule material used in each capsule may be in the range of 5 to 18 g, or 10 to 16 g.

In some embodiments, the ratio of total surface area of the exterior surfaces of the capsule to mass of capsule material is in the range of 90:5 (or 18:1) to 60:15 (or 4:1) $cm^2/g$. In this way, the capsule may have a relatively large exterior surface area for the amount of capsule material used. Such a configuration may provide a satisfactory dissolution rate of the capsule in use.

Laundry Detergent Composition

The water-soluble material forming the capsule encloses or contains a laundry detergent composition. In use, the water-soluble substrate may dissolve in water to release the laundry detergent composition enclosed within the capsule. Such laundry detergent compositions may be in solid, granular, gel or liquid form. In some embodiments, the laundry detergent composition is flowable and the capsule includes a flow control portion as described herein.

The amount of laundry detergent composition in each capsule may be in the range of 10 to 30 ml, 15 to 25 ml or 16 to 20 ml.

Capsule Material

The material of the capsule lid, capsule base and side wall or side walls is typically a water-soluble material. The exterior surface of the material is a surface that is intended to be exposed to the environment during use. The exterior surface typically opposes an interior surface intended to face or abut a laundry detergent composition to be contained, encased or enclosed in the capsule.

Suitable water-soluble materials are known. In particular, the water-soluble material may include one or more water-soluble polymers. In one embodiment, the water soluble material includes polyvinyl alcohol, a modified polyvinyl alcohol, polyvinyl acetate, polyacrylates, water soluble acrylate copolymers, polyaminopropyl sulfonic acid and salts thereof, polyitaconic acid and salts thereof, polyacrylamides, polyvinylpyrrolidone, pullalan, cellulosics (such as carboxymethylcellulose and hydroxypropyl methyl cellulose), water-soluble natural polymers (such as guar gum, xanthan gum, carrageenan and starch), water-soluble polymer derivatives (such as modified starches, including ethoxylated starch and hydroxylated propylstarch, poly(sodium acryloamido-2-methylpropane sulfonate, polymonomethylmaleate and salts thereof), copolymers thereof and combinations thereof. In some embodiments, the water soluble material includes, or consists essentially of, polyvinyl alcohol, a modified polyvinyl alcohol, polyvinyl acetate, carboxymethylcellulose or hydroxypropyl methyl cellulose.

In particular embodiments, the water-soluble material includes, or consists essentially of, polyvinyl alcohol, polyvinyl acetate and/or a modified polyvinyl alcohol. Polyvinyl alcohol, polyvinyl acetate and modified polyvinyl alcohols can provide stable water-soluble substrates that have suitable dissolution rates.

The water-soluble material may also contain one or more plasticizers. Examples of plasticizers include, but are not limited to glycerol, glycerin, diglycerin, ethylene glycol, diethylene glycol, triethylene glycol, tetraethylene glycol, monopropylene glycol, polyethylene glycol, neopentyl glycol, trimethylpropane polyether polyols, sorbitol, ethanolamines and mixtures thereof. The plasticizer, when present, may be included in the water-soluble material in an appropriate amount, as generally known.

In some embodiments, the water-soluble material includes a water-soluble polymer and a hygroscopic salt, the hygroscopic salt being present in the polymer material in an amount of at least 15% by weight based on the total weight of the polymer material. In some embodiments, the hygroscopic salt is an alkaline or alkaline earth metal salt. The hygroscopic salt may be an anhydrous or a hydrated alkaline or alkaline earth metal salt. In particular embodiments, the hygroscopic salt includes an anhydrous alkaline or alkaline earth metal salt. Examples of hygroscopic salts include, but are not limited to, sodium chloride, sodium citrate, calcium chloride, magnesium chloride, zinc chloride, potassium carbonate, potassium phosphate, carnallite, ferric ammonium citrate, potassium hydroxide, and sodium hydroxide. In some embodiments, the hygroscopic salt is selected from the group consisting of sodium chloride, sodium citrate, magnesium chloride and mixtures thereof. In particular embodiments, the hygroscopic salt is sodium chloride or sodium citrate.

The hygroscopic salt may be included in the water-soluble polymer material of the container in at least 15% by weight based on the total weight of the polymer material. In some embodiments, the hygroscopic salt is included in the water-soluble polymer material in an amount of 20% or more by weight based on the total weight of the polymer material. In particular embodiments, the hygroscopic salt is included in the water-soluble polymer material in an amount of 40% or more by weight based on the total weight of the water soluble polymer material. In further embodiments, the hygroscopic salt is included in the water-soluble polymer material in an amount of 50% or more by weight based on the total weight of the water soluble polymer material. The hygroscopic salt may be included in the water-soluble polymer material up to and including 75% by weight based on the total weight of the water soluble polymer material. In some embodiments the hygroscopic salt can be included in the water-soluble polymer material up to and including 70% by weight based on the total weight of the water soluble polymer material. In some embodiments the hygroscopic salt can be included in the water-soluble polymer material up to and including 65% by weight based on the total weight of the water soluble polymer material. Accordingly, the hygroscopic salt may be included in the water soluble polymer material of the container in the range of 15% to 75% by weight based on the total weight of the polymer material. In some embodiments, the hygroscopic salt is included in the water soluble polymer material of the container in the range of 40% to 70% by weight based on the total weight of the polymer material. In some embodiments, the hygroscopic salt is included in the water soluble polymer material of the container in the range of 50% to 65% by weight based on the total weight of the polymer material.

In some embodiments, the hygroscopic salt is micronized. In embodiments, the average particle diameter of the hygroscopic salt is less than 100 μm. In some embodiments, the average particle diameter of the hygroscopic salt is in the range of 0.03 to 75 μm. In particular embodiments, the hygroscopic salt has an average particle diameter in the range of 60 to 70 μm. In some embodiments, the hygroscopic salt has a coating layer. Such a coating layer may improve the salt particle properties. For example, the coating may act as an anti-caking agent. The hygroscopic salt coating layer may include sodium aluminosilicate, silicon dioxide and/or sodium hexacyanoferrate. In a particular embodiment, the coated hygroscopic salt is a sodium chloride particle coated with sodium aluminosilicate (E554), silicon dioxide (E551) and hexacyanoferrate.

In some embodiments, the material of the capsule lid, capsule base and side wall or side walls is an injection-moulded material. The material used to make these capsule components may be an injection-mouldable material. Injection moulding of the capsule components (e.g. the laundry detergent enclosure and the capsule lid) provides a simple process for manufacturing a plurality of capsule components (and thus capsules described herein) on a production line. In some embodiments, the material of the capsule lid, capsule base and side wall or side walls is a thermoformed material. Such injection moulded and/or thermoformed materials are known per se.

Method of Producing Capsule

The capsule of the present invention can be manufactured using standard known techniques. For example, a water-soluble material may be formed (preferably thermo-formed) into a laundry detergent enclosure (e.g. capsule base and side wall or side walls). The cavity of the laundry detergent enclosure may then be filled with a laundry detergent composition, typically through the cavity aperture formed by the upper rim of the side wall or side walls. The laundry detergent enclosure containing the laundry detergent composition is then sealed by attaching the capsule lid. The lid may be sealed to the laundry detergent enclosure by any known means, such as using an adhesive or heat-sealing a portion of the lid to the enclosure. In some embodiments, the capsule lid includes a sonic energy-directing portion and the lid is sonic welded to the capsule enclosure.

Method of Producing Capsule Lid and Capsule Enclosure

The capsule lid and capsule enclosure as described herein may be formed by any known method. In particular embodiments, the capsule lid and/or the capsule enclosure is formed from injection moulding. In other words, the capsule lid and/or capsule enclosure are injection moulded.

In particular embodiments, the laundry detergent capsule lid is formed of a single piece of injection moulded material. In other words, the lid portion and the lid the flange, along with any lid reinforcing ribs or lid reinforcing rib engagement portions present, are formed of a single piece of injection-moulded material.

In particular embodiments, the laundry detergent capsule enclosure is formed from a single piece of injection moulded material. In other words, the capsule base, the capsule side wall or side walls, along with any capsule enclosure reinforcing ribs or capsule enclosure reinforcing rib engagement portions present, are formed of a single piece of injection-moulded material.

Package of Capsules

The present invention may provide a container including a plurality of laundry detergent capsules as described herein. The container is not particularly limited. In some embodiments, the container is a plastic container.

In other embodiments, the plurality of packaged capsules is a box containing a two dimensional or linear array of laundry detergent capsules containing laundry detergent composition, the box having a height of no more than 3.5 cm. In some embodiments, the box contains a two dimensional array of laundry detergent capsules containing a laundry detergent composition, each capsule having a substantially planar lid and a substantially planar base, each capsule independently having a height in the range of 1.5 and 2.5 cm and each capsule lid or capsule base having a lateral dimension in the range of 3.0 and 5.0 cm.

The two-dimensional array as described herein typically means that the capsules are arranged in a configuration that extends at least two capsules wide, at least two capsules deep and no more than one capsule high. The linear array of capsules as described herein typically means that the capsules are arranged in a configuration that extends at least two capsules wide, no more than one capsules deep and no more than one capsule high.

Typically, the box will have a box base for receiving the capsules, box side walls to encase the capsule and a box lid to seal the capsules within the box.

Particular Combinations

In a particular embodiment, the laundry detergent capsule includes a capsule base with one or more side walls extending from the base to form a detergent composition cavity accommodating a laundry detergent composition, wherein the capsule includes a capsule lid for sealing the detergent composition cavity and the capsule lid includes a ridge extending downwardly from a lid portion, the ridge forms a single continuous ridge extending substantially around the entire circumference or perimeter of the inner surface of the upper rim of the side wall or side walls, the upper rim of the side wall or side walls having an indentation on the inner surface of the side walls to accommodate the ridge and the indentation has a shelf abutting a lower surface of the ridge to support the ridge. In this embodiment, the capsule may include a gap (for example, a gap of 0.1 to 3 mm) between the inner surface of the side wall or side walls and the outer surface of the ridge.

Additionally or alternatively, the ridge may extend along 5 to 30% of the height of the side wall or side walls. Additionally in this embodiment, the laundry detergent capsule may further includes a plurality of lid reinforcing ribs extending from the lid portion and a plurality of capsule enclosure reinforcing rib engagement portions attached to the capsule base, wherein the plurality of lid reinforcing ribs extend the height of the cavity to abut the capsule base and the plurality of capsule enclosure reinforcing rib engagement portions include two opposed guiding portions with a gap that is wider at the mouth of the gap than at the capsule base.

Each preferred and optional feature described herein may be equally combined with another preferred or optional feature described herein. In particular, the preferred and optional features of the laundry detergent capsule of the first aspect may be a preferred or optional feature of container of the third aspect or the use of the fourth aspect. Where there is a reference to a side wall or side walls and the capsule includes more than one side wall, the feature may apply to one or more side walls of the capsule. In particular embodiments, the feature may apply to all side walls of the capsule.

Figure 1A:
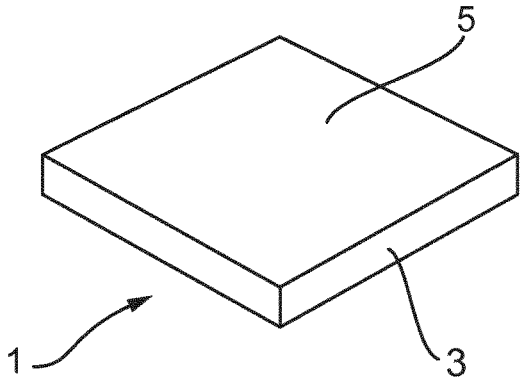
FIGS. 1 and 2 show a perspective view and cross-section view of two examples of capsule lids for use with the capsule of the present invention.
Figure 1B:
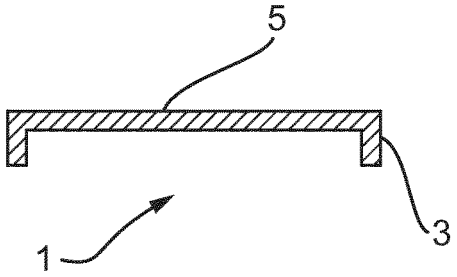

Turning to the Figures, FIG. 1*a* shows a capsule lid 1 having a rim 3 extending around the perimeter of a lid portion 5. The lid portion 5 is substantially flat and square in shape. FIG. 1*b* shows a cross-section of the capsule lid 1 of FIG. 1*a* showing the rim 3 is positioned at the outer edge of the lid portion 5. The rim 3 is configured to abut or be in close proximity to either the outer or inner edge of the upper rim of four side walls arranged in a complementary square pattern.

Figure 2A:
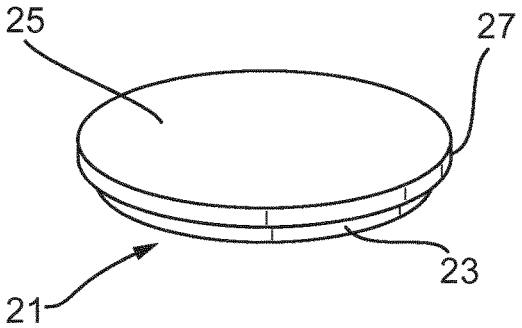
Figure 2B:
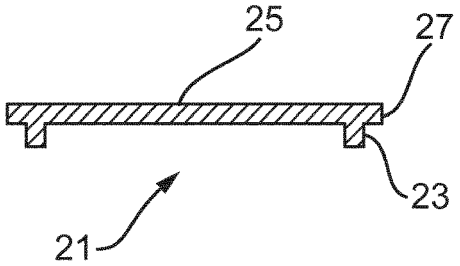

FIG. 2*a* shows a capsule lid 21 having a ridge 23 extending around the perimeter of a lid portion 25. The lid portion 25 is substantially flat and circular in shape. FIG. 2*b* shows a cross-section of the capsule lid 21 of FIG. 2*a* showing the ridge 23 is positioned in the proximity of the outer edge of the lid portion 25. The lid portion 25 has a lip portion 27 extending beyond the outer edge of the ridge 23 and is configured to abut an upper rim of the side wall of the capsule. The ridge 23 is configured to abut or be in close proximity to either the outer or inner edge of the upper rim of a complementary cylindrical side wall.

Figure 3A:
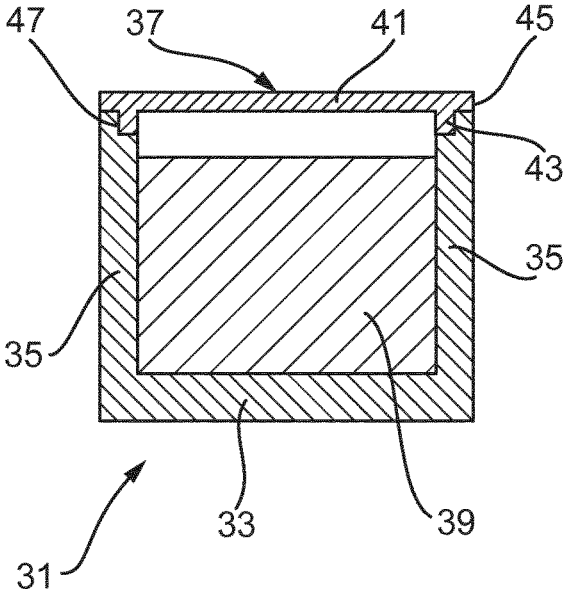
FIG. 3 shows a cross-section view of two examples of capsules of the present invention.
Figure 3B:
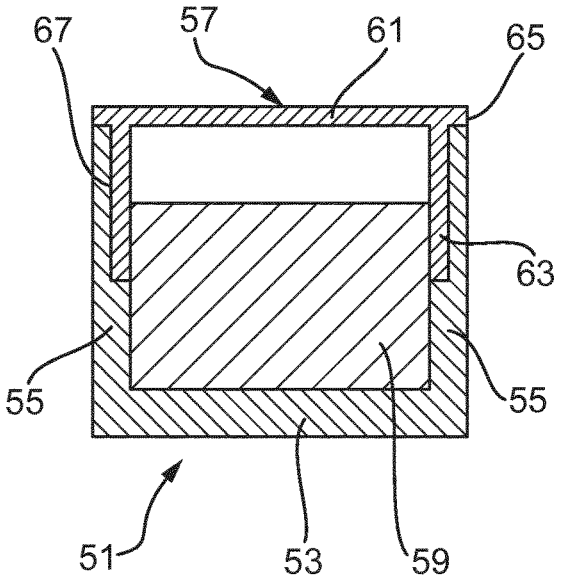

FIG. 3 shows two capsules 31, 51 including a capsule base 33, 53, side wall or side walls 35, 55, a capsule lid 37, 57 and a laundry detergent composition 39, 59. Each capsule lid 37, 57 has a substantially flat lid portion 41, 61, a ridge 43, 63 extending downwardly and a lip portion 45, 65. The upper rim of the side wall or side walls 35, 55 has an L-shaped groove or indentation 47, 67 that abuts against and engages with the ridge 43, 63 and lip portion 45, 65 of the capsule lid 37, 57. This engagement (in a variety of configurations) is shown in more detail in FIG. 4. The ridge 43 in FIG. 3*a* extends only a relatively small proportion of the height of the side wall/side walls 35, whereas the ridge 63 in FIG. 3*b* extends almost 50% of the height of the side wall/side walls 55.

FIG. 4 shows the specific interaction between the flange of the capsule lid with the upper rim of the side wall in various configurations. FIG. 4*a* shows a side wall 101 and the outer edge of a capsule lid 103. The capsule lid 103 has a ridge 105 extending downwardly from a substantially flat lid portion 107. The ridge 105 abuts the inner surface of the side wall 101. The lid portion includes a lip portion 109 at the edge of the lid portion 107. The lip portion 109 rests on the substantially flat upper rim of the side wall 101. The outer edge of the lid portion 107 is arranged to be flush with the outer surface of the side wall 101.

Figure 4A:
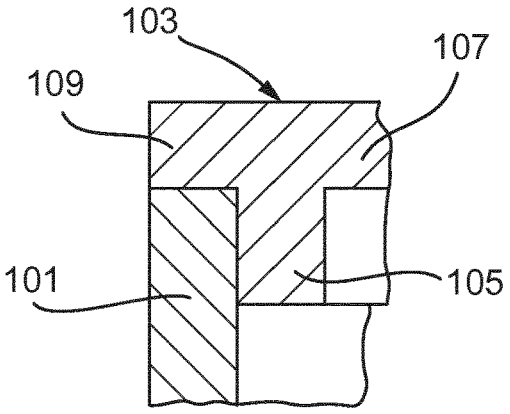
FIG. 4 shows a zoomed-in cross-section of part of six examples of capsules of the present invention showing the interaction of the capsule lid with the upper rim of the side wall.
Figure 4B:
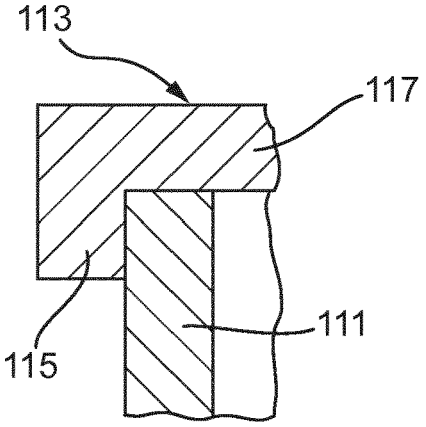

FIG. 4*b* shows a side wall 111 and the outer edge of a capsule lid 113. The capsule lid 113 has a rim 115 extending downwardly from a substantially flat lid portion 117. The rim 115 abuts the outer surface of the side wall 111. A surface of the lid portion 117 rests on the substantially flat upper rim of the side wall 111.

Figure 4C:
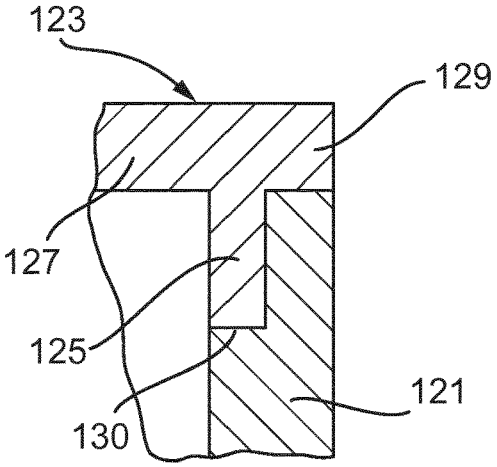

FIG. 4*c* shows a side wall 121 and the outer edge of a capsule lid 123. The capsule lid 123 has a ridge 125 extending downwardly from a substantially flat lid portion 127. The ridge 125 abuts the inner surface of the side wall 121. The lid portion includes a lip portion 129 at the edge of the lid portion 127. The lip portion 129 rests on the substantially flat upper rim of the side wall 121. The upper rim of the side wall 121 includes an L-shaped groove or indentation that abuts against and engages with the ridge 125 and lip portion 129 of the capsule lid 123. The peak of the ridge 125 rests on a shelf 130 of the side wall 121 (created by the L-shaped indentation). The outer edge of the lid portion 127 is arranged to be flush with the outer surface of the side wall 121. The inner edge of the ridge 125 is arranged to be flush with the inner surface of the side wall 121.

Figure 4D:
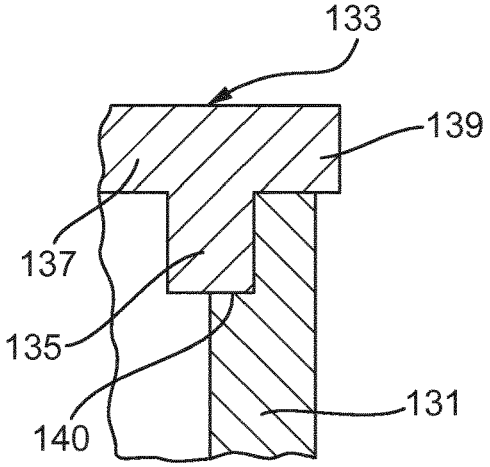

FIG. 4*d* shows a side wall 131 and the outer edge of a capsule lid 133. The capsule lid 133 has a ridge 135 extending downwardly from a substantially flat lid portion 137. The ridge 135 abuts the inner surface of the side wall 131. The lid portion includes a lip portion 139 at the edge of the lid portion 137. The lip portion 139 rests on the substantially flat upper rim of the side wall 131. The upper rim of the side wall 131 includes an L-shaped groove or indentation that abuts against and engages with the ridge 135 and lip portion 139 of the capsule lid 133. The peak of the ridge 135 rests on a shelf 140 of the side wall 131 (created by the L-shaped indentation). The outer edge of the lid portion 137 protrudes from or extends beyond the outer surface of the side wall 131. The inner edge of the ridge 135 protrudes from or extends beyond with the inner surface of the side wall 131.

Figure 4E:
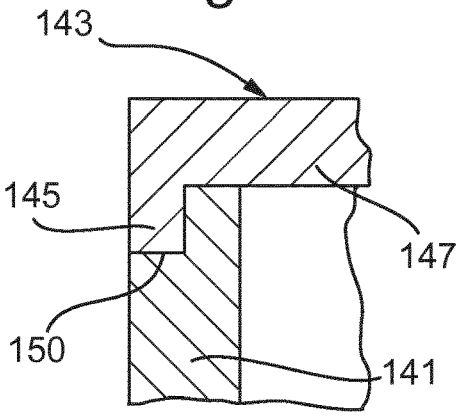

FIG. 4*e* shows a side wall 141 and the outer edge of a capsule lid 143. The capsule lid 143 has a rim 145 extending downwardly from a substantially flat lid portion 147. The rim 145 abuts the outer surface of the side wall 141. A surface of the lid portion 147 rests on the substantially flat upper rim of the side wall 141. The upper rim of the side wall 141 includes an L-shaped groove or indentation that abuts against and engages with the rim 145 of the capsule lid 143. The peak of the rim 145 rests on a shelf 150 of the side wall 141 (created by the L-shaped indentation). The outer edge of the lid portion 147 is arranged to be flush with the outer surface of the side wall 141.

Figure 4F:
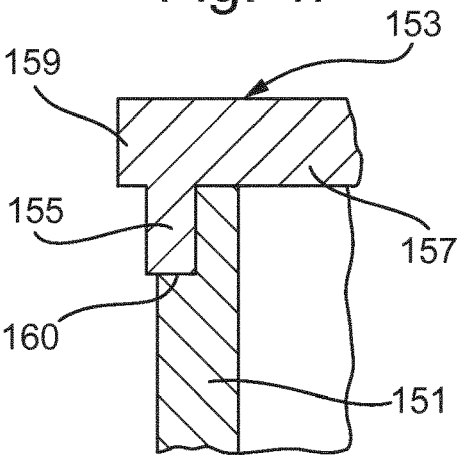

FIG. 4*f* shows a side wall 151 and the outer edge of a capsule lid 153. The capsule lid 153 has a ridge 155 extending downwardly from a substantially flat lid portion 157. The ridge 155 abuts the outer surface of the side wall 151. The lid portion 157 includes a lip portion 159 at the edge of the lid portion 157. The upper rim of the side wall 151 includes an L-shaped groove or indentation that abuts against and engages with the ridge 155 of the capsule lid 153. The peak of the ridge 155 rests on a shelf 160 of the side wall 151 (created by the L-shaped indentation). The outer edge of the lid portion 157 protrudes from or extends beyond the outer surface of the side wall 151.

In alternative configurations of FIGS. 4*c* to 4*f* inclusive, the ridge 125, 135, 155 or rim 145 abuts only the shelf 130, 140, 150, 160 of the side wall 121, 131, 141, 151 and there is a gap of about 1 to 2 mm between the outer surface of the ridge 125, 135 and the inner surface of the side wall 121, 131 or between the inner surface of the ridge 155 or rim 145 and the outer surface of the side wall 141, 151.

Figure 5A:
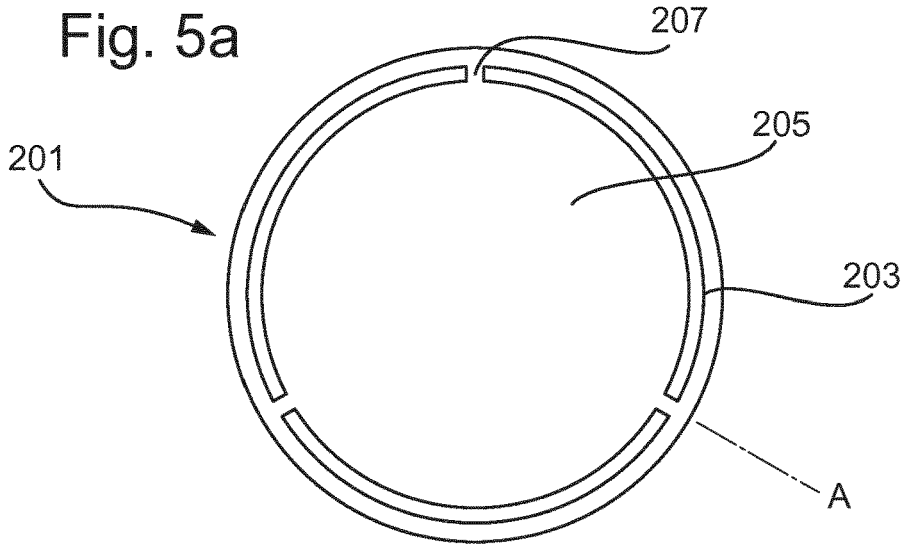
FIGS. 5 and 6 show a plan view and a side view of two examples of the capsule lid for use in the capsule of the present invention showing gaps or breaks in the ridge extending from the lid portion.
Figure 5B:
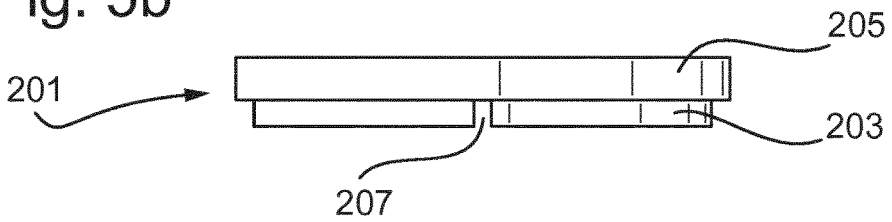

FIG. 5 shows a capsule lid 201 with a ridge 203 extending around the outer edge of a lid portion 205. The ridge 203 has three short breaks 207 spaced symmetrically along the length of the ridge 203. FIG. 5*a* shows a plan view of the capsule lid 201 as viewed from the bottom of the capsule lid 201 in order to show the ridge 203. FIG. 5*b* shows a side view of the capsule lid 201 of FIG. 5*a* shown from the angle A. The ridge 203 extends downwardly from the lid portion 205. The break 207 in the ridge 203 has a square shape.

Figure 6A:
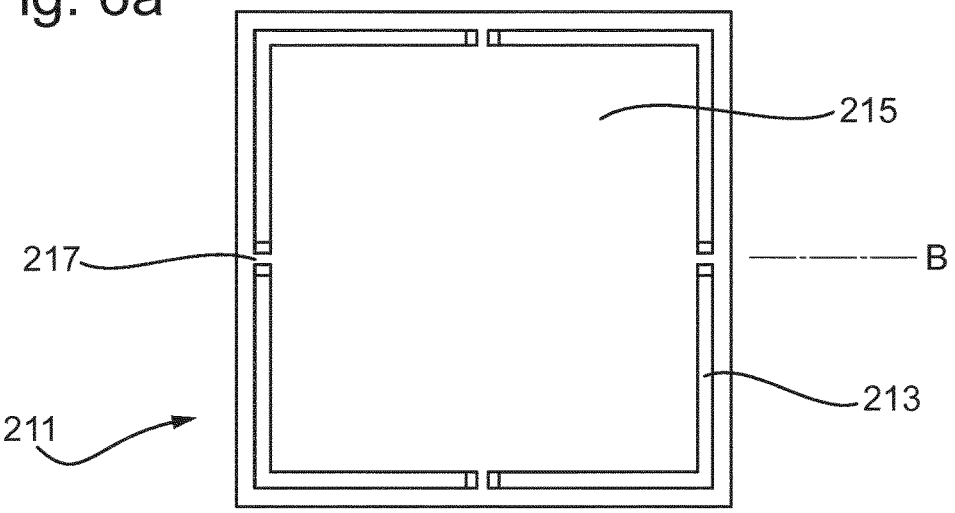
Figure 6B:
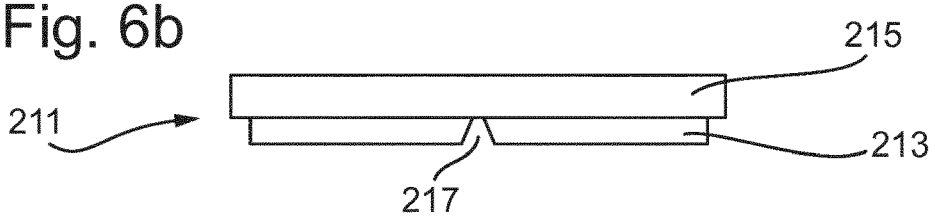

FIG. 6 shows a capsule lid 211 with a ridge 213 extending around the outer edge of a lid portion 215. The ridge 213 has four short breaks 217 spaced symmetrically along the length of the ridge 213. FIG. 6*a* shows a plan view of the capsule lid 211 as viewed from the bottom of the capsule lid 211 to show the ridge 213. FIG. 6*b* shows a side view of the capsule lid 211 of FIG. 6*a* shown from the angle B. The ridge 213 extends downwardly from the lid portion 215. The break 217 in the ridge 213 has a truncated triangle shape.

Figure 7:
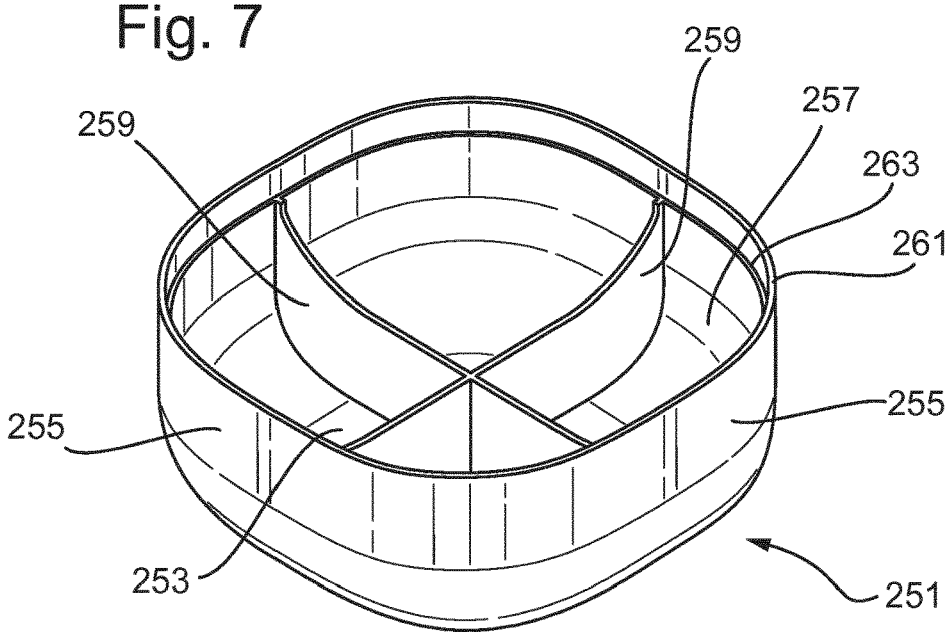
FIG. 7 shows a perspective view of a laundry detergent capsule enclosure for use in forming a laundry detergent capsule described herein.

FIG. 7 shows a perspective view of a laundry detergent capsule enclosure 251. The enclosure 251 has a substantially flat capsule base 253 and four side walls 255 extending substantially vertically from the capsule base 253. The edges between the capsule base 253 and the side walls 255 are rounded. The edges between each side wall 255 are also rounded to form a squircle or rounded square side wall shape. The side walls 255 and capsule base 253 enclose or surround a capsule cavity 257 designed to house a laundry detergent composition.

Within the capsule cavity 257, the capsule includes two intersecting reinforcement ribs 259. Each reinforcement rib 259 extends upwardly from the capsule base 253 and is attached to an interior surface of a capsule side wall 255. The reinforcing ribs 259 extend across the width of the capsule base 253 so that each rib 259 is attached to two capsule side walls 255. The height of the reinforcing ribs 259 at any point along the rib generally matches contour of the capsule base 253. In this way, when the capsule base 253 is substantially flat, the height of the reinforcing ribs 259 is substantially the same along the length of the reinforcing ribs 259. This height of the reinforcing ribs 259 is around 50% of the height of the capsule side walls 255. When the reinforcing rib 259 approaches the side wall 255, the absolute height of each rib 259 increases because the contour of the rib 259 follows the contour of the rounded edge between the capsule base 253 and the capsule side wall 255. When the reinforcing ribs 259 meet the side walls 255, the height of the reinforcing ribs 259 is around 80% of the height of the side walls 255.

The upper rim 261 of the side walls 255 has an L-shaped indentation 263 on the interior surface to receive a flange on a capsule lid. The indentation 263 extends around 10 to 20% of the height of the side walls 255. The capsule base 253, side walls 255 and reinforcement ribs 259 are formed as a single piece by injection moulding.

Figure 8A:
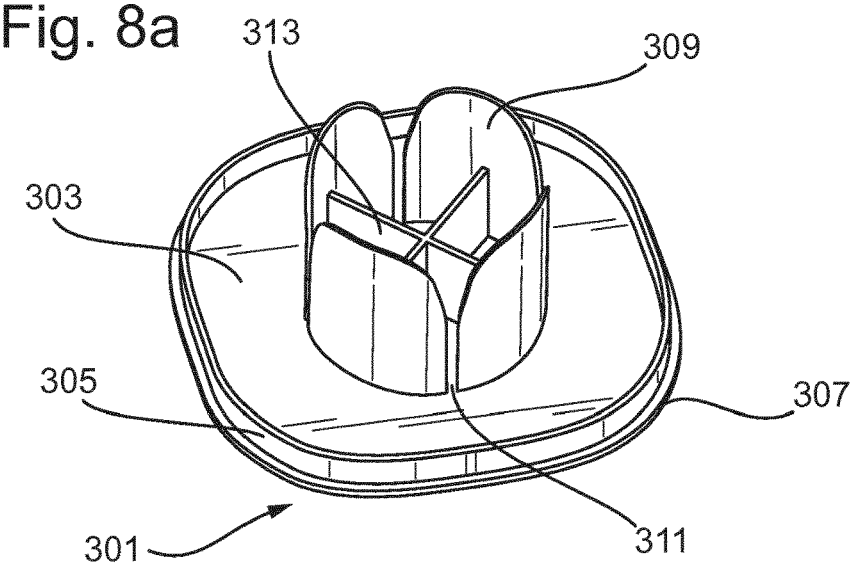
FIG. 8 shows a perspective view (FIG. 8*a*) and a side view (FIG. 8*b*) of a capsule lid for use in forming the laundry detergent capsule described herein.
Figure 8B:
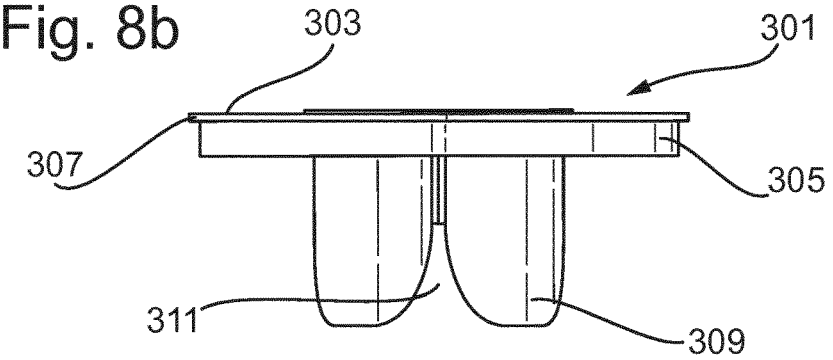

FIG. 8 shows a perspective view (FIG. 8*a*) and a side view (FIG. 8*b*) of a capsule lid 301 for use in forming the laundry detergent capsule. The capsule lid 301 has a flat lid portion 303 with a rounded square or squircle shape. The shape complements the shape created by the upper rim of the side walls in the laundry detergent capsule enclosure of FIG. 7. A flange 305 extends from the lid portion 303 in close proximity to an edge of the lid portion 303. The flange 305 extends downwardly when the capsule lid 301 is attached to a laundry detergent composition enclosure described herein to form a laundry detergent composition capsule of the invention. A lip portion 307 of the lid portion is formed between the flange 305 and the edge of the lid portion 303.

A cylindrical tubular reinforcement rib engaging portion 309 extends from a central portion of the capsule lid portion 303. The tubular reinforcement rib engaging portion 309 has four equally spaced slots 311 extending from a rim of the tubular reinforcement rib engaging portion 309 to the lid portion 303 for receiving and engaging with four parts of the reinforcing ribs within the capsule cavity of a laundry detergent composition enclosure described herein. The slots 311 are tapered so that engagement with the reinforcing ribs is facile. The tubular reinforcement rib engaging portion 309 also includes two intersecting reinforcement struts 313 attached to the lid portion 303 of the capsule lid 301 and the interior surfaces of the tubular reinforcement rib engaging portion 309. The reinforcing struts 313 attach to the interior surfaces of the tubular reinforcement rib engaging portion 309 in between the tapered slots 311. In this way, the reinforcing struts 313 may not interfere with the engagement of the tubular reinforcement rib engaging portion 309 with the reinforcing ribs.

Figure 9:
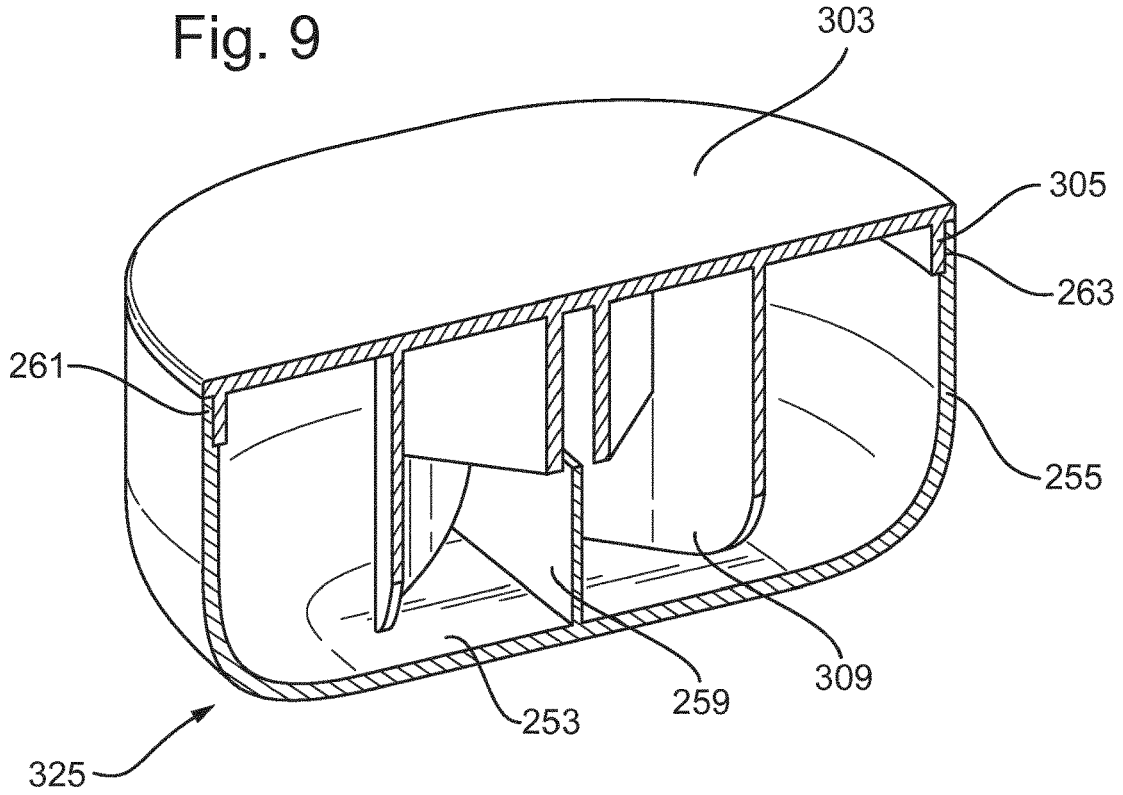
FIG. 9 shows cut-through section of a laundry capsule described herein formed from the capsule enclosure of FIG. 7 and the capsule lid of FIG. 8 (note: the laundry detergent composition is not shown).

FIG. 9 shows cut-through section of a laundry capsule 325 of the present invention formed from the capsule enclosure 251 of FIG. 7 and the capsule lid 301 of FIG. 8. Note that the laundry detergent composition is not shown. The reinforcing rib engagement portion 309 engages with the reinforcing ribs 259. The reinforcing rib engagement portion 309 further extends downwardly from the lid portion 303 of the capsule lid 301 to the capsule base 253 and may provide further reinforcement to the capsule 325. The reinforcing struts 313 of the reinforcing rib engagement portion 309 abut a central part of the reinforcing ribs 259 and may provide further reinforcement to the capsule 325. The flange 305 of the capsule lid 301 abuts or is in close proximity to the L-shaped indentation 263 formed in the upper rim 261 of the side walls 255 of the capsule 325.

Figure 10:
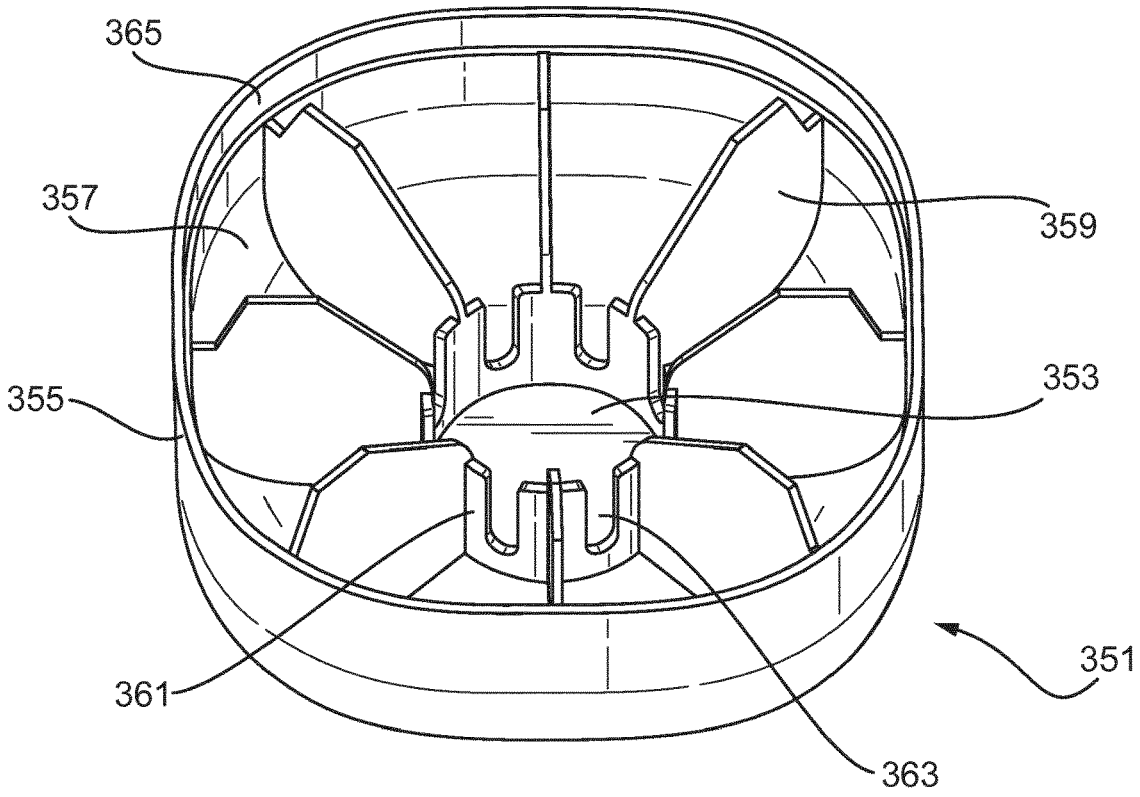
FIG. 10 shows a perspective view of another example of a laundry detergent capsule enclosure for use in forming a laundry detergent capsule described herein.

FIG. 10 shows a perspective view of another example of a laundry detergent capsule enclosure 351 for use in forming a laundry detergent capsule of the present invention. The enclosure 351 has a substantially flat capsule base 353 and four side walls 355 extending substantially vertically from the capsule base 353. The edges between the capsule base 353 and the side walls 355 are rounded. The edges between each side wall 355 are also rounded to form a squircle or rounded square side wall shape. The side walls 355 and capsule base 353 enclose or surround a capsule cavity 357 designed to house a laundry detergent composition.

Within the capsule cavity 357, the capsule enclosure 351 includes eight intersecting reinforcement ribs 359 extending radially from a central part of the capsule cavity 357. Each reinforcement rib 359 extends upwardly from the capsule base 353. The reinforcement ribs 353 do not meet in the centre of the capsule enclosure 351. Instead, each reinforcement rib 359 extends from the interior surface of a capsule side wall 355 to a central flow control portion 361. The height of the reinforcing ribs 359 varies along its length.

The central flow control portion 361 is a tubular hollow cylindrical flow control portion extending upwardly from a central portion of the capsule base 353. The reinforcing ribs 359 are attached to the exterior surface of the flow control portion 361. The flow control portion 361 has eight tongue-shaped indentations 363 extending from the upper rim of the flow control portion 361 to serve as flow outlets. Each indentation 363 is positioned symmetrically about the circumference of the upper rim of the flow control portion 361 and positioned in between the attachment points of the reinforcing ribs 359. In this way, the flowable laundry detergent composition can be added to the tubular hollow cylindrical flow control portion 361, for example, to control splashing of the flowable laundry detergent composition, in use. The flowable laundry detergent composition may flow to areas of the capsule cavity 357 that are outside of the tubular hollow cylindrical flow control portion 361, for example, through the tongue-shaped flow outlets 363.

The upper rim of the side walls 355 has an L-shaped indentation 365 on the interior surface to receive a flange on a capsule lid. The indentation 365 extends around 10 to 20% of the height of the side walls 355. The capsule base 353, side walls 355, reinforcement ribs 359 and central flow control portion 361 are formed as a single piece by injection moulding.

Figure 11:
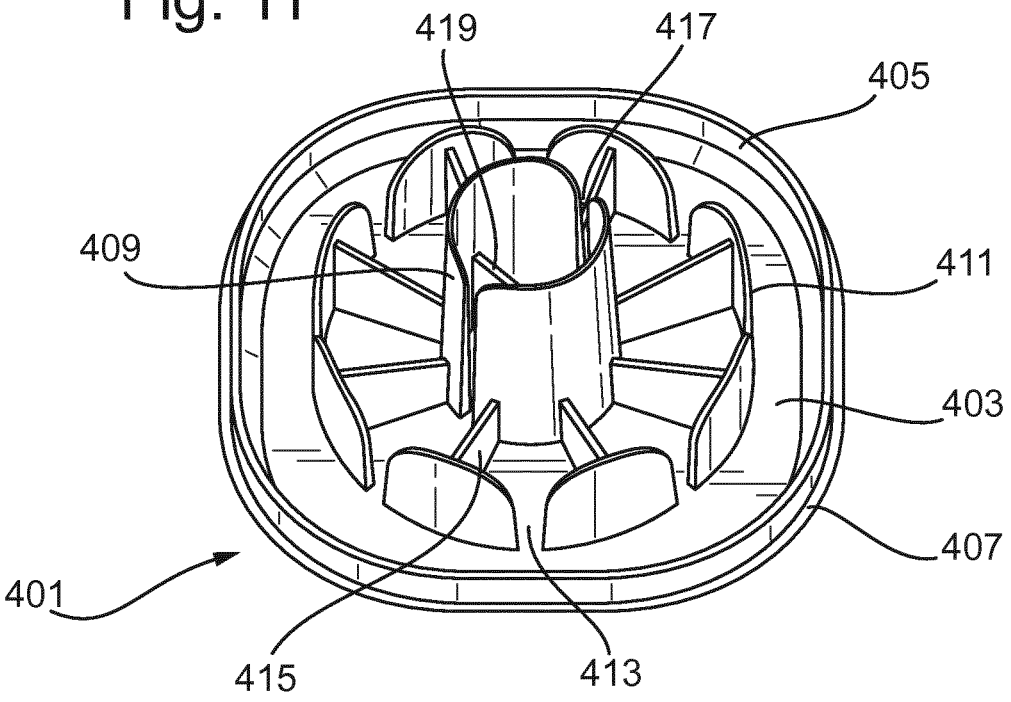
FIG. 11 shows a perspective view of another example of a capsule lid for use in forming the laundry detergent capsule described herein.

FIG. 11 shows a perspective view of another example of a capsule lid 401 for use in forming the laundry detergent capsule of the present invention. The capsule lid 401 has a flat lid portion 403 with a rounded square or squircle shape. The shape complements the shape created by the upper rim of the side walls in the laundry detergent capsule enclosure of FIG. 10. A flange 405 extends from the lid portion 403 in close proximity to the outer edge of the lid portion 403. The flange 405 extends downwardly when the capsule lid 401 is attached to a laundry detergent composition enclosure described herein to form a laundry detergent composition capsule of the invention. A lip portion 407 is formed between the flange 405 and the outer edge of the lid portion 403.

An inner cylindrical tubular central flow engaging portion 409 and an outer cylindrical tubular reinforcing rib engagement portion 411 extend concentrically from a central portion of the capsule lid 401.

The tubular reinforcement rib engaging portion 411 has eight equally spaced slots 413 extending from a rim of the tubular reinforcement rib engaging portion 411 to the lid portion 403 for receiving and engaging with eight parts of the reinforcing ribs within the capsule cavity of a laundry detergent composition enclosure described herein. The slots 413 are tapered so that engagement with the reinforcing ribs is facile. The tubular reinforcement rib engaging portion 411 also includes eight reinforcement struts 415 attached to the lid portion 403 of the capsule lid 401 and the exterior surfaces of the tubular central flow portion engaging portion 409. The reinforcing struts 415 attach to the interior surfaces of the tubular reinforcement rib engaging portion 411 in between the tapered slots 413. In this way, the reinforcing struts 415 may not interfere with the engagement of the tubular reinforcement rib engaging portion 411 with the reinforcing ribs.

The central flow portion engagement portion extends 409 (downwardly, in use) from the lid portion 403 of the capsule lid 401. The central flow portion engagement portion 409 has an outer diameter adapted to be slightly less than the inner diameter of a hollow tubular central flow portion so that the central flow portion engagement portion 409 can engage with the interior surfaces of the hollow tubular central flow portion. The central flow portion engagement portion 409 has two slots 417 extending from the rim of the central flow portion engagement portion 409 to the capsule lid portion 403. In this way, the central flow portion engagement portion 409 may have some flexibility to fit within and engage with the central flow portion in forming a laundry detergent capsule described herein. The central flow portion engagement portion 409 further has a reinforcing strut 419 attached to the lid portion 403 of the capsule lid 401 and the interior surfaces of the central flow portion engagement portion 409.

Figure 12:
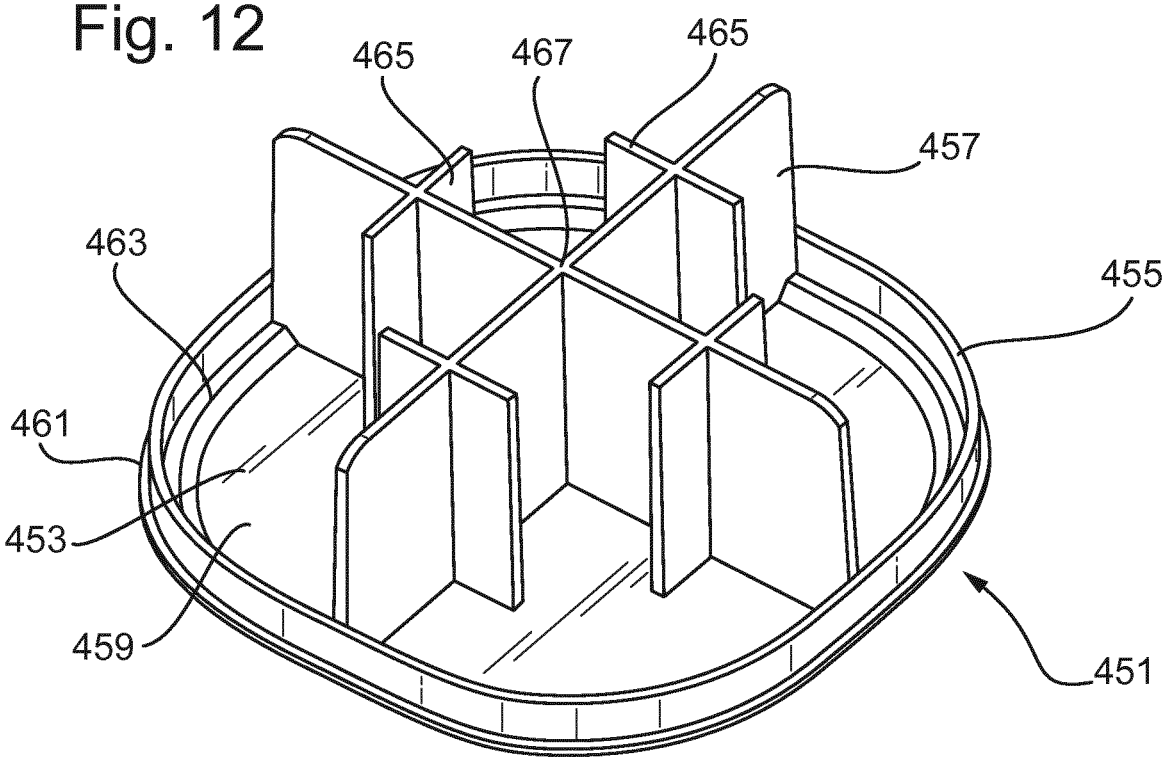
FIG. 12 shows a perspective view of a further example of a capsule lid for use in forming the laundry detergent capsule described herein

FIG. 12 shows a laundry detergent capsule lid 451 having a substantially planar lid portion 453, a flange 455 and four reinforcing ribs 457, where the flange 455 and four reinforcing ribs 457 are attached to and extend from a surface of the lid portion 453.

The lid portion 453 is substantially planar, and includes a central lid portion 459, an outer peripheral lip portion 461 and an annular sloped portion 463 connecting the central lid portion 459 to the lip portion 461. All three sections are made as a single injection-moulded piece of material. The flange 455 extends from the lip portion 461. The reinforcing ribs 457 extend from the central lid portion 459.

The laundry detergent capsule lid 451 includes four lid reinforcing ribs 457. The ribs 457 extend radially from a central or intersection point 467 where all four lid reinforcing ribs 457 meet in a cross shape. Alternatively, the laundry detergent capsule lid 457 can be considered to have two intersecting lid reinforcing ribs 457, wherein each lid reinforcing rib 457 extends from an inner surface of the flange 455 to another inner surface of the flange 455.

The reinforcing ribs 457 are substantially planar with a major plane extending perpendicularly from the plane of the central lid portion 459. The reinforcing ribs 457 extend in the major plane from a central or intersection point 467 to the inner surface of the flange 455 and from the lower surface of the lid portion 453. The height of the lid reinforcing rib 457 is about the internal height of a capsule cavity, such that a lower surface of the lid reinforcing rib 457 can be adjacent to or abutting an internal surface of a capsule base when combined with a laundry detergent capsule enclosure to form a laundry detergent capsule.

The corner of each lid reinforcing rib 457 that is distal from both the central or intersecting point and the lid portion 453 is rounded to be adjacent to or abut the edge of the laundry detergent capsule enclosure where the capsule base and capsule side wall meet.

Each lid reinforcing rib 457 has two ancillary lid reinforcing ribs 465. Each ancillary reinforcing ancillary rib 465 extends substantially perpendicularly from the major plane of the lid reinforcing rib 457. Each ancillary lid reinforcing rib 465 extends from the lid reinforcing rib 457 by around a quarter of the length of the lid reinforcing rib 457. Each ancillary lid reinforcing rib 465 is positioned along the lid reinforcing rib 457 about half way between the flange 455 and central or intersecting point 467 of the lid reinforcing ribs.

Figure 13:
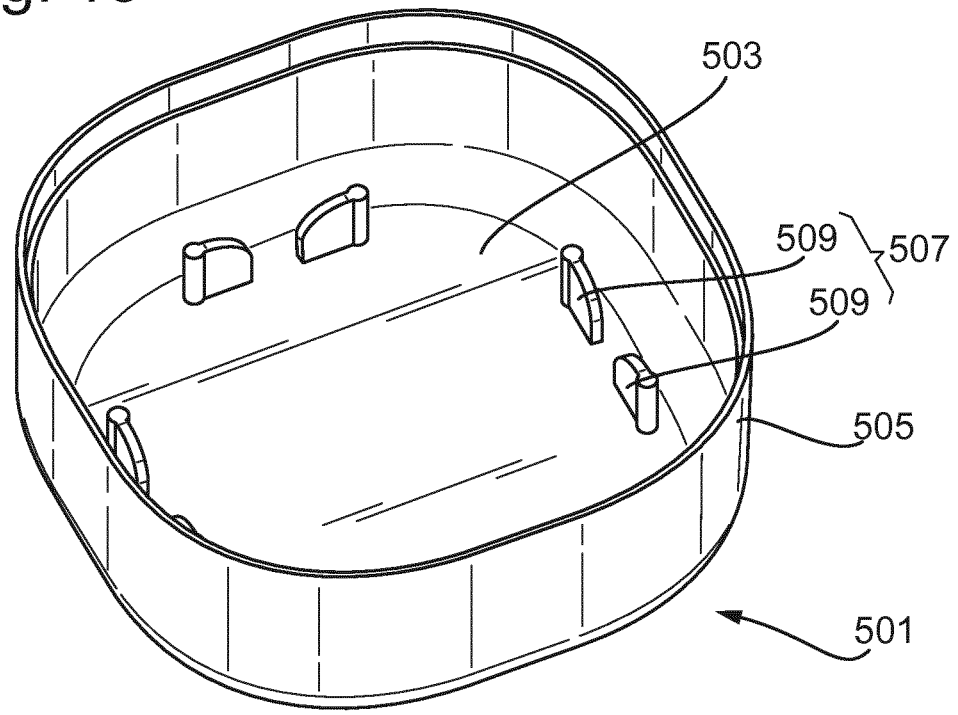
FIG. 13 shows a perspective view of a further example of a laundry detergent capsule enclosure for use in forming a laundry detergent capsule described herein.

FIG. 13 shows a laundry detergent capsule enclosure 501 adapted to be used with the laundry detergent capsule lid of FIG. 12. The capsule base 503 and side walls 505 are similar to the embodiments shown in FIGS. 7 and 10. The internal reinforcement structures are provided on the lid, so the capsule base 503 does not include capsule enclosure reinforcing ribs. The capsule base 503 includes four lid reinforcing rib engagement portions 507 formed from two opposed lid reinforcing rib guiding members 509.

The opposed lid reinforcing rib guiding members 509 are separated by a gap of at least the thickness of the lid reinforcing ribs. In this way, the lid reinforcing ribs can be accommodated in the gap between the lid reinforcing rib guiding members 509. The gap between the lid reinforcing rib guiding members 509 is narrower at the capsule base 503 than at the opening of the gap between the lid reinforcing rib guiding members 509. In this way the lid reinforcing ribs can be guided into the gap.

Figure 14:
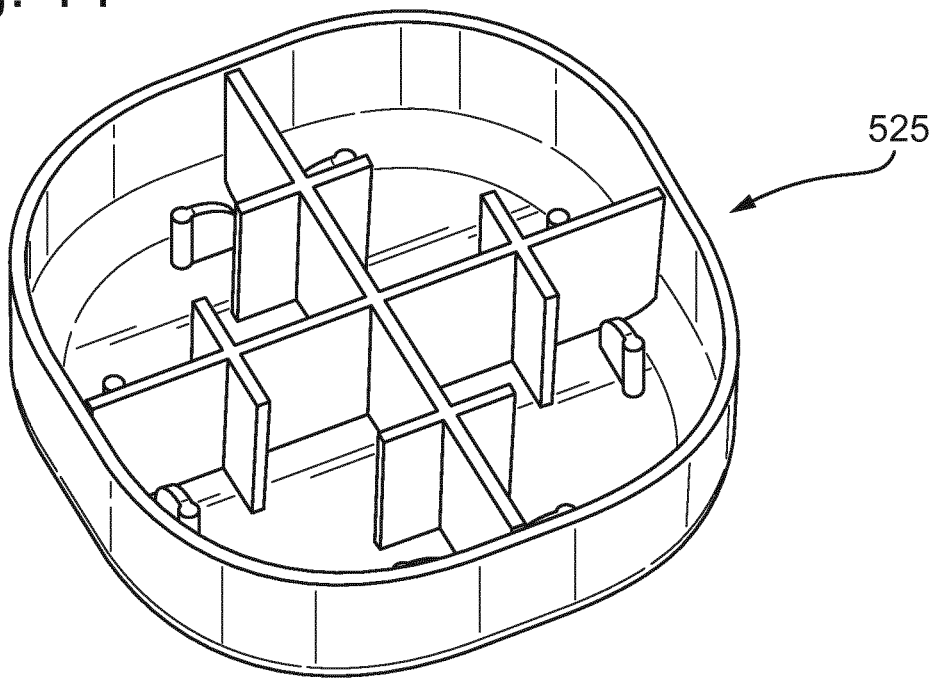
FIG. 14 shows a perspective view of cut-away of a laundry detergent capsule formed from the laundry detergent lid of FIG. 12 with the laundry detergent capsule enclosure of FIG. 13 (note the lid portion is not shown).
Figure 15:
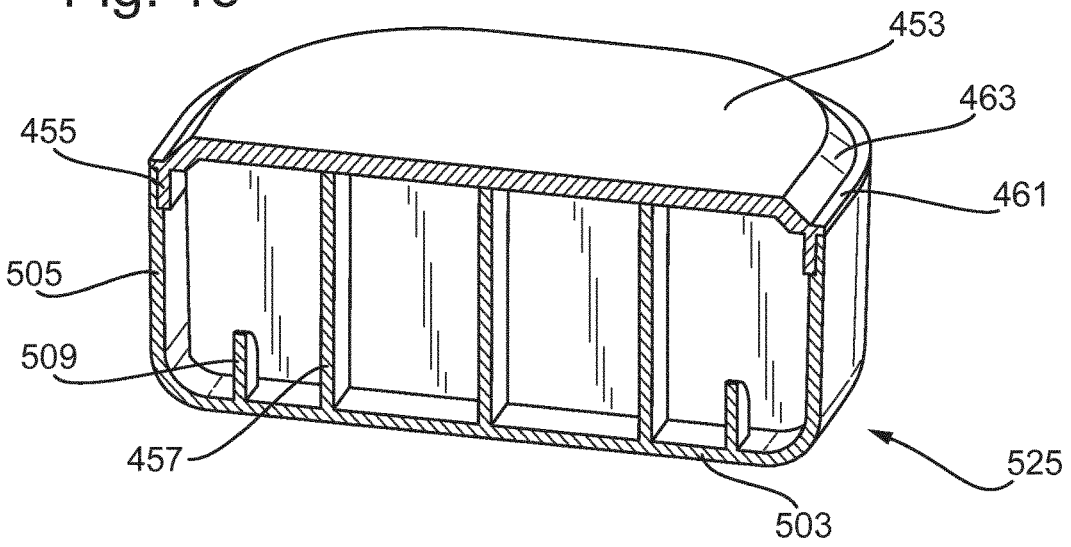
FIG. 15 shows a perspective view of cut-away of a laundry detergent capsule of FIG. 14.
Figure 16:
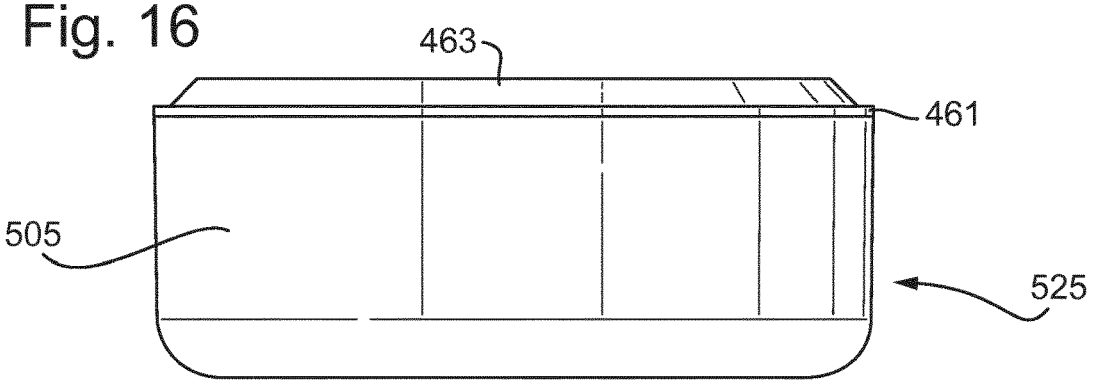
FIG. 16 shows a side-view of the laundry detergent capsules of FIGS. 14 and 15.

FIGS. 14 and 15 show the laundry detergent capsule lid 451 of FIG. 12 in combination with the laundry detergent capsule enclosure 501 of FIG. 13 to form a laundry detergent capsule 525 as described herein. Note that a laundry detergent composition is not shown in FIG. 14 or 15, and the lid portion is not shown in FIG. 14. FIG. 16 shows an exterior side view of the laundry detergent capsule 525 of FIGS. 14 and 15.

FIGS. 17*a* and 17*b* show a section of a laundry detergent capsule 551 as described herein. The capsule lid 553 has a triangular sonic energy directing portion 555 extending from the lower surface of a lip portion 557 of the lid 553. The sonic energy directing portion 555 extends around the entire circumference of the lid 553. The upper surface of the side wall 559 has a complementary groove to accommodate the triangular sonic energy directing portion 555. The flange 561 extends from the lid portion 557.

The invention claimed is:

1. A laundry detergent capsule containing a laundry detergent composition, the capsule including a capsule base with one or more side walls extending from the base to form a detergent composition cavity accommodating the laundry detergent composition, wherein the capsule includes a capsule lid for sealing the detergent composition cavity, the capsule base, side wall(s) and/or lid include a water-soluble material and the capsule lid includes a flange extending from a lid portion and abutting the side wall or side walls, wherein the flange is a ridge or rim extending downwardly from the lid portion, the peak of the flange rim or ridge extends concentrically with the upper rim of side wall or side walls and the flange rim or ridge extends for 80% or more of the circumference or perimeter of the upper rim of the side wall or side walls, and the flange rim or ridge has 2, 3, 4, 5 or 6 breaks or gaps arranged symmetrically around the circumference or perimeter of the upper rim of the side wall or side walls.

2. The laundry detergent capsule according to claim 1 wherein an outer surface of the flange abuts an inner surface of the side wall or side walls, or there is a gap in the range of 0.01 to 5 mm between an outer surface of the flange and an inner surface of the side wall or side walls.

3. The laundry detergent capsule according to claim 1 wherein the flange extends downwardly from the lid portion up to 60% of the height of the capsule side wall or side walls.

4. The laundry detergent capsule according to claim 1 wherein the upper rim of the side wall or side walls includes an L-shaped groove or indentation to engage and support the flange of the capsule lid.

5. The laundry detergent capsule according to claim 1 wherein the capsule includes one or more reinforcing ribs within the detergent composition cavity and the reinforcing ribs are attached to the interior surface of the capsule base, the interior surface of the capsule side wall and/or the capsule lid.

6. The laundry detergent capsule according to claim 1 wherein the capsule includes a flowable laundry detergent composition, a flow control portion within the laundry detergent cavity and the reinforcing rib extends from the side wall to the flow control portion.

7. A container including a plurality of laundry detergent capsules according to claim 1.

8. A composition of a laundry detergent capsule according to claim 1 to launder textiles.

* * * * *